US009241588B2

(12) United States Patent
Dunn et al.

(10) Patent No.: US 9,241,588 B2
(45) Date of Patent: Jan. 26, 2016

(54) NON-SPILL DRINKING CONTAINER

(71) Applicant: Munchkin, Inc., Van Nuys, CA (US)

(72) Inventors: Steven Bryan Dunn, Beverly Hills, CA (US); Mark A. Hatherill, Beverly Hills, CA (US); Kevin Douglas Johnson, Tarzana, CA (US); Matthew Joseph Saxton, Agoura, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 14/514,186

(22) Filed: Oct. 14, 2014

(65) Prior Publication Data

US 2015/0102032 A1 Apr. 16, 2015

Related U.S. Application Data

(60) Provisional application No. 62/000,887, filed on May 20, 2014, provisional application No. 61/891,409, filed on Oct. 16, 2013.

(51) Int. Cl.
*A47G 19/22* (2006.01)

(52) U.S. Cl.
CPC ..... *A47G 19/2272* (2013.01)

(58) Field of Classification Search
CPC ..... A47G 19/2272
USPC ..... 220/714, 203.16, 231; 215/11.5, 311, 215/309
See application file for complete search history.

(56) References Cited

U.S. PATENT DOCUMENTS 1,254,251 A 1/1918 Magnus
2,414,697 A 9/1945 Pettersson
(Continued)

FOREIGN PATENT DOCUMENTS

CN 102006804 B 5/2012
GB 2482294 8/2013
(Continued)

OTHER PUBLICATIONS

International Search Report and Written Opinion for PCT/US2014/060744.
(Continued)

*Primary Examiner* — Fenn Mathew
*Assistant Examiner* — James N Smalley
(74) *Attorney, Agent, or Firm* — Robert Z. Evora, Esq.; Wade C. Yamazaki, Esq.

(57) ABSTRACT

A non-spill container assembly having a container, a collar and an annular seal from which drinking can occur at any location around a rim of the container assembly. The collar has an internal frustoconical shape wall with a circular upper end that extends downward and inwardly into a closed lower end. The closed lower end has a projection that extends outward from its center. The collar includes a support surface arranged along an inner surface of an upper edge of the circular upper end and a fastener assembly disposed adjacent to a bottom of the collar provided to securely fasten to a container. A plurality of passages are radially disposed around the projection in the internal frustoconical shape wall to channel a fluid. A plurality of radial protrusions disposed radially adjacent to the support surface defining various channels along the support surface. An annular seal is constructed in a form of a frustoconical disc substantially similar to a shape of internal frustoconical shape wall, the annular seal having a blind bore recess on a lower surface at its center for receiving and securing onto the projection.

20 Claims, 23 Drawing Sheets

(56) References Cited

U.S. PATENT DOCUMENTS

| | | | |
|---|---|---|---|
| 2,534,614 | A | 12/1950 | Michael |
| 2,623,368 | A | 12/1952 | Olsen |
| 3,015,411 | A | 1/1962 | Smith |
| 3,208,629 | A | 9/1965 | Beeson |
| 3,338,467 | A | 8/1967 | Albert |
| 3,360,160 | A | 12/1967 | Spencer |
| 3,360,161 | A | 12/1967 | Smith |
| 3,549,044 | A | 12/1970 | Lerner |
| 3,727,808 | A | 4/1973 | Fitzgerald |
| 3,797,696 | A | 3/1974 | Dibrell |
| 3,915,331 | A | 10/1975 | Chenault |
| 3,938,695 | A | 2/1976 | Ruff |
| 4,130,215 | A | 12/1978 | Corey |
| 4,184,603 | A | 1/1980 | Hamilton, Sr. |
| 4,193,519 | A | 3/1980 | Dubach et al. |
| 4,238,045 | A | 12/1980 | D'Andria |
| 4,460,101 | A | 7/1984 | Tseng |
| 5,249,703 | A | 10/1993 | Karp |
| 5,370,258 | A | 12/1994 | Fair |
| 5,540,350 | A | 7/1996 | Lansky |
| 5,890,619 | A | 4/1999 | Belanger |
| 5,979,689 | A | 11/1999 | Lansky |
| 6,102,244 | A | 8/2000 | Kuwano et al. |
| 6,102,245 | A | 8/2000 | Haberman |
| 6,116,457 | A | 9/2000 | Haberman |
| 6,176,399 | B1 | 1/2001 | Schantz et al. |
| 6,202,877 | B1 | 3/2001 | La Torre et al. |
| 6,325,236 | B1 | 12/2001 | Wong |
| 6,488,170 | B1 | 12/2002 | Johnson |
| 6,640,992 | B1 | 11/2003 | Berger et al. |
| 6,659,302 | B2 | 12/2003 | Lin |
| 6,702,145 | B2 | 3/2004 | Malcolm |
| 6,745,915 | B2 | 6/2004 | Rees |
| 7,168,589 | B2 | 1/2007 | Dark |
| 7,549,556 | B2 | 6/2009 | Miller |
| 7,575,126 | B2 | 8/2009 | Kemper |
| 7,712,622 | B2 | 5/2010 | Ruccolo |
| 8,025,178 | B2 | 9/2011 | Miller |
| 8,033,420 | B2 | 10/2011 | Roseblade et al. |
| 8,191,728 | B2 | 6/2012 | Auer et al. |
| 8,272,525 | B1 | 9/2012 | La Torre et al. |
| 8,333,299 | B2 | 12/2012 | Kemper et al. |
| 8,453,870 | B2 | 6/2013 | Berg |
| 2005/0224495 | A1 | 10/2005 | Kartinian |
| 2009/0139950 | A1* | 6/2009 | Greter et al. ..... 215/11.5 |
| 2011/0084084 | A1 | 4/2011 | Berg |
| 2013/0233870 | A1 | 9/2013 | Miller |

FOREIGN PATENT DOCUMENTS

| | | | |
|---|---|---|---|
| NO | 328413 | B1 | 2/2010 |
| WO | 00/48491 | | 8/2000 |
| WO | 02/11587 | A1 | 2/2002 |
| WO | 03/061438 | A1 | 7/2003 |
| WO | 2009/126042 | A1 | 10/2009 |

OTHER PUBLICATIONS

International Search Report and Written Opinion for PCT/US2014/060744 Mailed Feb. 5, 2015 (pp. 1-14).

* cited by examiner

10

NON-SPILL DRINKING CONTAINER

CROSS REFERENCE TO RELATED APPLICATIONS

The application claims priority to U.S. Provisional Patent Application Ser. No. 61/891,409, filed Oct. 16, 2013, and U.S. Provisional Patent Application Ser. No. 62/000,887, filed May 20, 2014; the contents of which are hereby incorporated by reference herein in their entirety into this disclosure.

TECHNICAL FIELD

The subject disclosure relates to a drinking container. More particularly, to a spill-proof drinking container assembly having a 360 degree sealed lip enclosure from which a user can drink along any peripheral edge of the container and withdraw fluid from within the container assembly.

BACKGROUND

Various types of spill-proof containers are known. As a parent attempts to wean an infant away from a conventional bottle, typically, an interim or transition spill-proof container with a spout is useful before the child can comfortably handle and use a conventional open top cup. Unfortunately, in these formative years, young children struggle with having complete control over holding and carrying a traditional open cup. Consequently, spillage frequently occurs when the infant or child knocks over their cup and causes substantial leakage onto the ground, themselves or elsewhere.

Non-spill container covers for drinking containers have been long sought after for many years. Various coverings for fluid-filled containers have been manufactured for use by a person who is in motion, such as a cover for a hot coffee container to be used in a moving vehicle such as an automobile. However, traditional non-spill container covers generally required relatively complex parts and valve structures in addition to restricting the particular area from which a user can drink from the container cover.

Accordingly, there is a need for the development of a transition cup which does not easily spill when knocked over.

SUMMARY

A non-spill collar and valve assembly comprising a collar having an internal frustoconical shape wall with a circular upper end that extends downward and inwardly into a closed lower end. The closed lower end has a projection that extends outward from its center to receive a flexible annular seal. A support surface is arranged along an inner surface of an upper edge of the circular upper end. A plurality of protrusions are disposed radially adjacent to the support surface defining various channels along the support surface. A plurality of passages are radially disposed around the projection in the internal frustoconical shape wall. The flexible annular seal is constructed in a form of a frustoconical disc having an internal shape substantially similar to a shape of internal frustoconical shape wall. The flexible annular seal has a blind bore recess on a lower surface at its center for receiving and securing onto the projection. An attachment mechanism is provided at the bottom of the collar provided to securely fasten the collar to a container.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
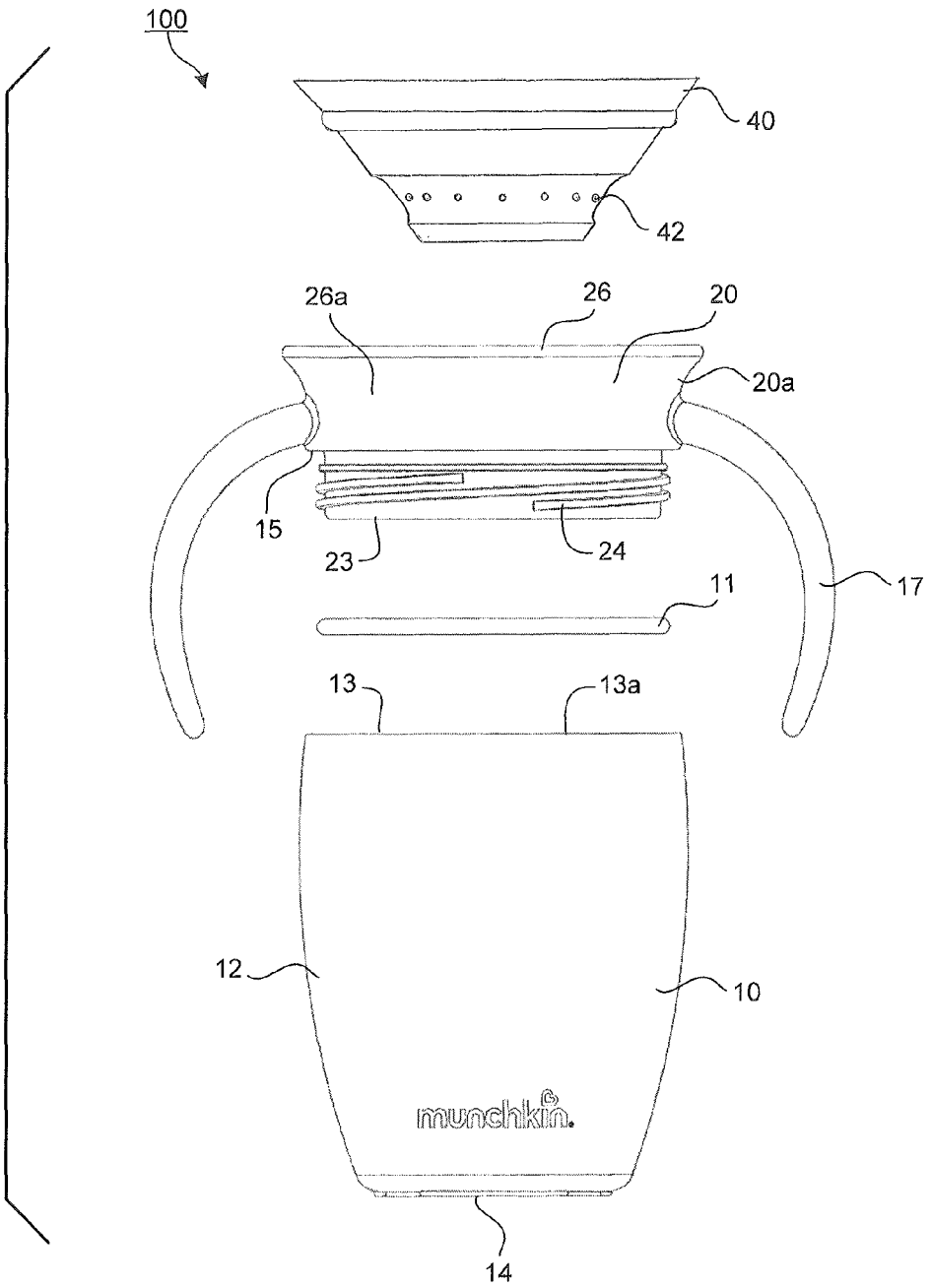
FIG. 1 illustrates an exploded view of an exemplary non-spill container assembly with a collar having a pair of handles according to the subject disclosure.
Figure 2:
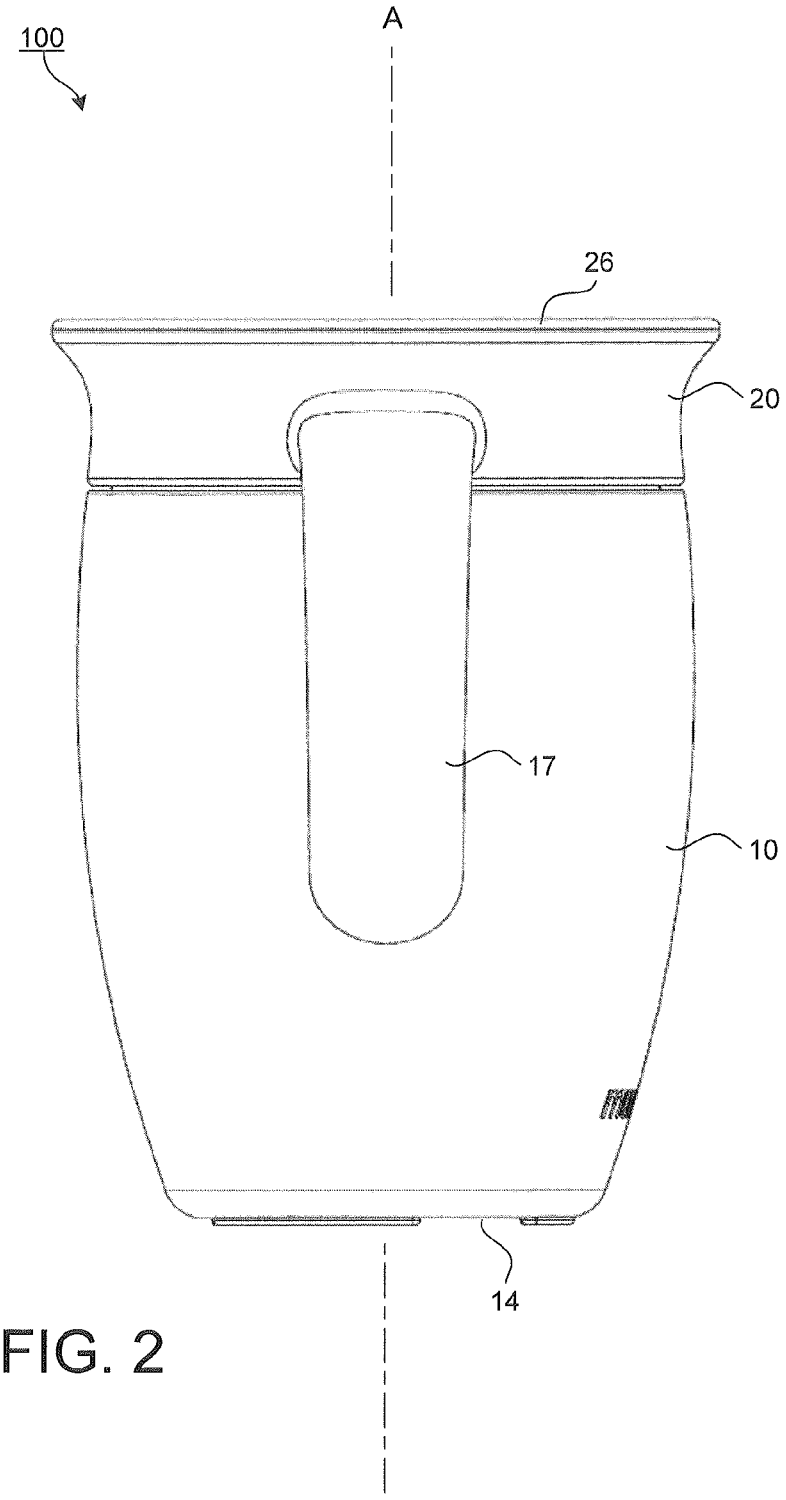
FIG. 2 shows a side view of the non-spill container assembly.

FIGS. 1 and 2 show an exploded view, and an assembled side view of an exemplary non-spill drinking container assembly 100. The drinking container assembly 100 includes a container 10, a resilient sealing ring 11, a collar 20 and an annular seal 40. The container assembly 100 is conducive to helping young children and/or adults who may lack the motor skill coordination to transition to an open cup. The container assembly 100 allows the user to sip or drink from anywhere around the rim 26 with ease.

The container 10 shown in FIGS. 1-2 is substantially cylindrical in shape about a central axis (A) and has a side wall 12, a first open end 13 and a second closed end 14. The first open end 13 of the container 10 has a central opening 13*a* adapted to receive a fluid stored within the container 10. It is to be understood that container 10 can take any suitable size or shape capable of holding a fluid and receiving the collar 20 and the annular seal 40, such as a square shape or other suitable obtuse shape.

Figure 8:
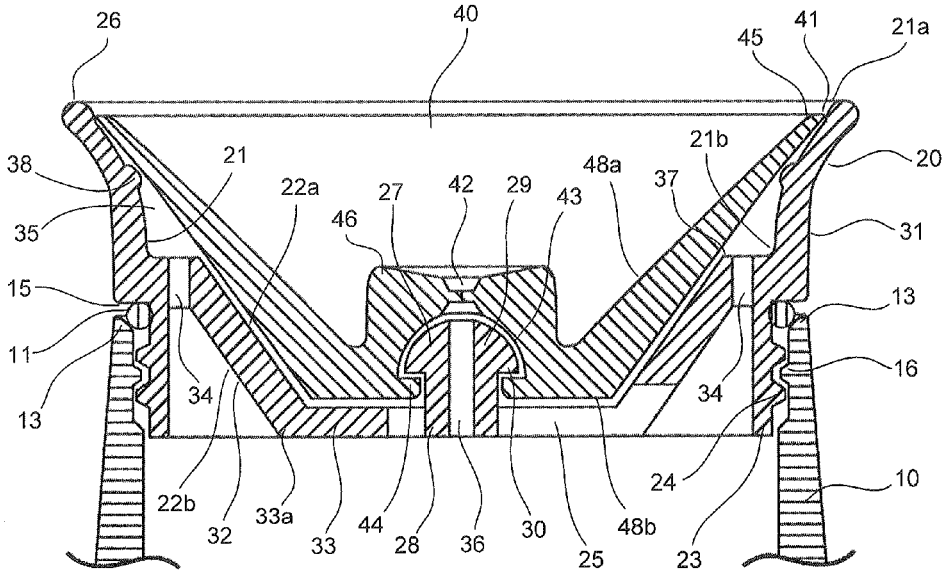
FIG. 8 illustrates a cross section view of the upper end of the non-spill container assembly.

The collar 20 may be a frustoconical cylindrical shape. The collar 20 includes an upper surface 22*a* that faces upward and lies within the upper end 13*a* of the container 10, as shown in FIG. 8. The collar 20 also includes a lower surface 22*b* that faces downward toward the container 10 away from the annular seal 40 in assembly.

Figure 7:
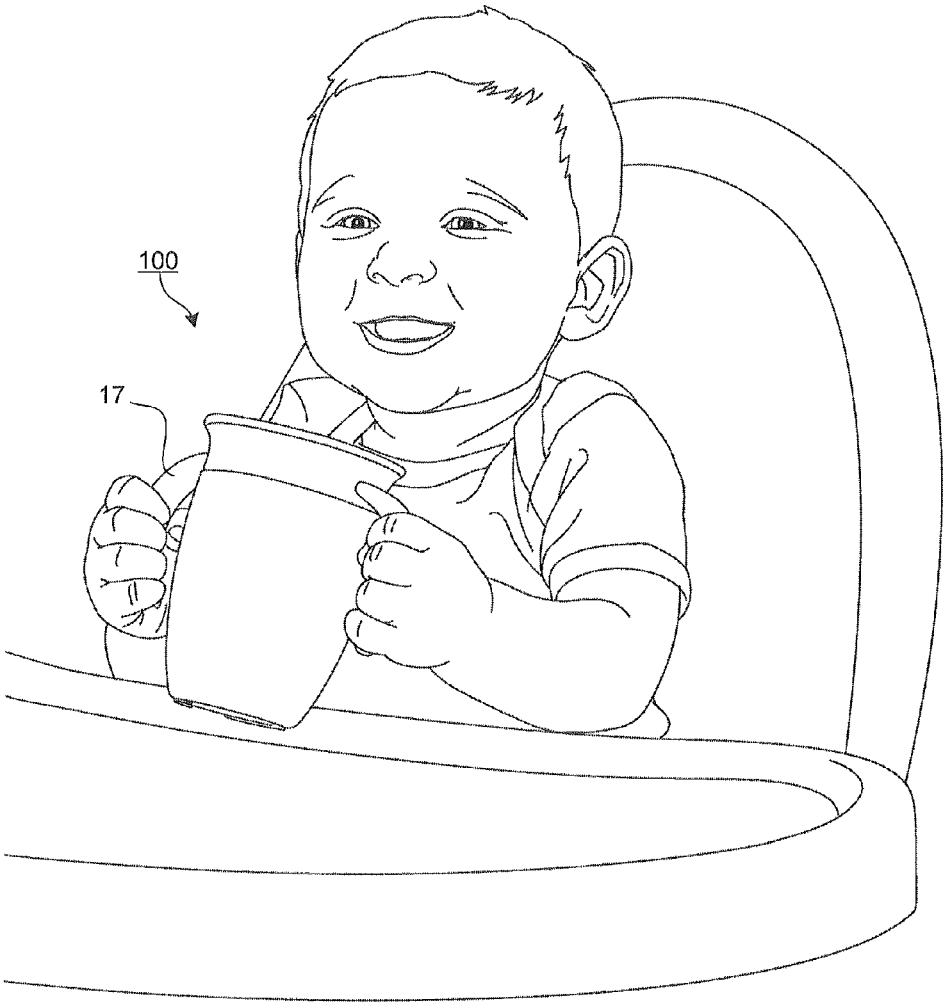

According to this embodiment, the collar 20 includes a pair of handles 17 that extend from sides 20*a* of the collar 20. The handles 17 extend outward and downwardly forming two curved arms. The handles 17 provide the additional advantage to an infant or person who may have difficulty holding the container 10 of the container assembly 100. The handles 17 allow a user to comfortably hold the container 10 by the arms of the handles 17 with a firm grip and in a stable manner, as shown in FIG. 7.

The collar 20 includes a lower end 23 having a first diameter and an upper end 26*a* adjacent to the rim 26 having a second larger diameter. The upper end 26*a* and the lower end 23 meet at a junction defining a concentric shoulder 15. A securing fastener assembly is adapted to secure the lower end 23 of the collar 20 to the container 10.

At the concentric shoulder 15, the diameter of the upper end 26*a* of the collar 20 expands outward to a larger diameter defining the concentric shape of the outer side 20*a* of the collar 20. The larger diameter of the upper end 26*a* of the collar 20 flares upwardly and outward from the concentric shoulder 15 to an upper rim 26 adjacent to an uppermost end or rim 26 of the collar 20.

The annular seal 40 is constructed in the form of a frustoconical disc, as shown in FIGS. 1, 8, 13-16, 17-19, 21-22 and 29-34. The annular seal 40 includes a lower surface 48*b* that lies adjacent to the upper surface 22*a* of the collar 20 in assembly. The annular seal 40 also includes an upper surface 48*a* that faces upward away from the collar 20 in assembly. The lower surface 48*b* of the annular seal 40 has a frustoconical shape that substantially mirrors the frustoconical shape of the upper surface 22*a* of the collar 20 that it is attached to in assembly.

In assembly, the annular seal 40 is secured to an open upper surface 22*a* of the collar 20. The lower end 23 of the collar 20 is fastened via a fastener assembly to the upper open end 13 of the container 10. Assembled, the resilient seal ring 11 is disposed between the upper open end 13 of the container 10 and the concentric shoulder 15 of the collar 20. The concentric shoulder 15 is constructed to constrict inwardly from the outer surface 20*a* of the upper end 26*a* of the collar 20 to an inner surface having a smaller diameter defining the lower end 23. The fastener assembly provided at the lower end 23 of the collar are male threads 24.

The male threads 24 may make up the fastener assembly connection disposed adjacent to the lower end 23 of the collar 20 to mate with, and secure against various female threads 16 disposed on an inside surface of the upper end 13 of the container 10, as shown in FIG. 8. Although a threaded assembly attachment is shown here, it is to be understood that various other suitable constructions for the secure assembly connection mechanism between the collar 20 and the container 10 may be used.

Figure 3:
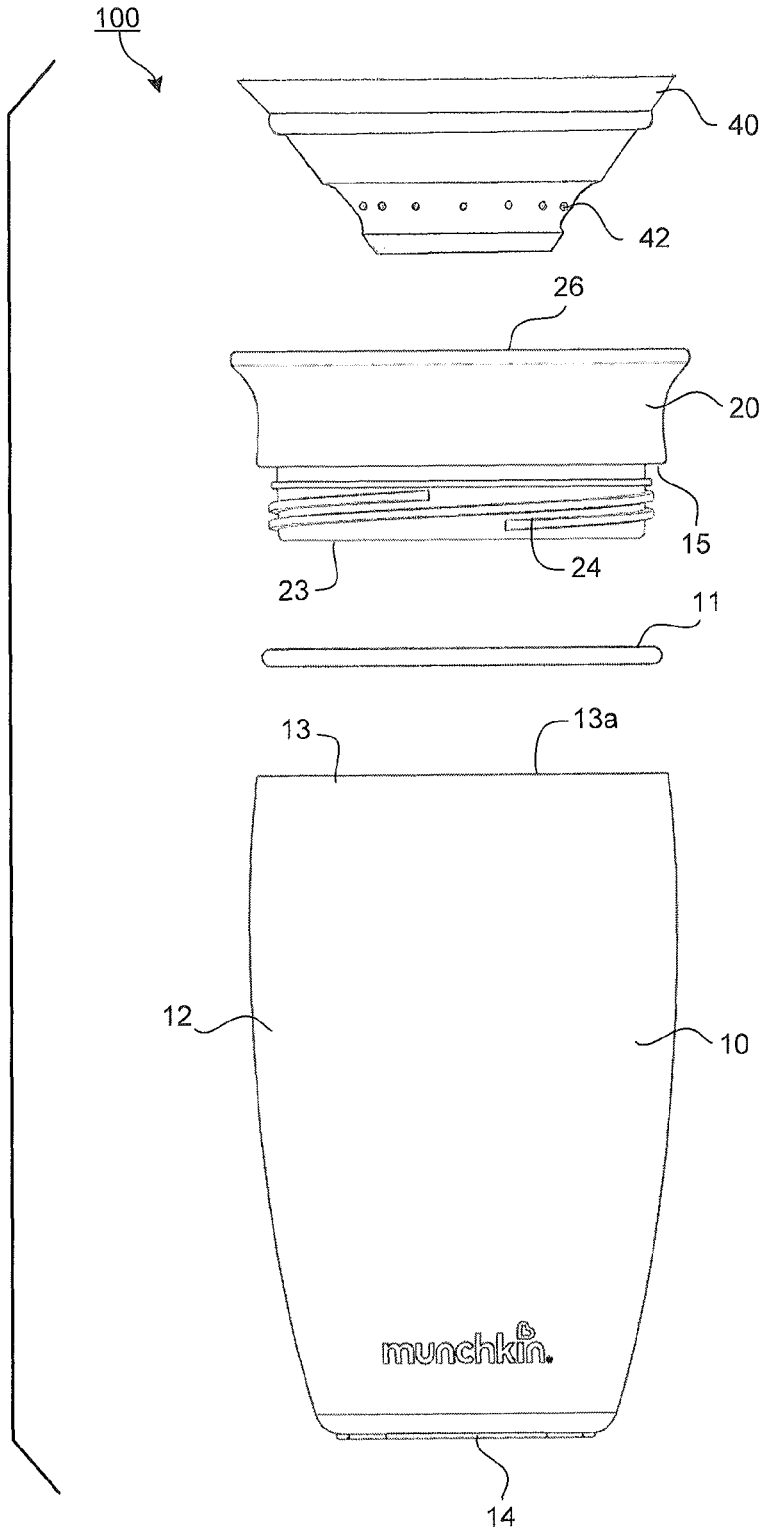
FIG. 3 depicts an exploded view of the non-spill container assembly without the handles.

FIG. 3 shows an alternative collar 20 design without handles attached to the collar 20 in accordance with the subject matter of this disclosure. Ideally, this design is adapted for use by a more mature child or individual with better motor skills capable of securely gripping the outer surface of the container 10 of the container assembly 100 according to the subject disclosure.

Figure 4:
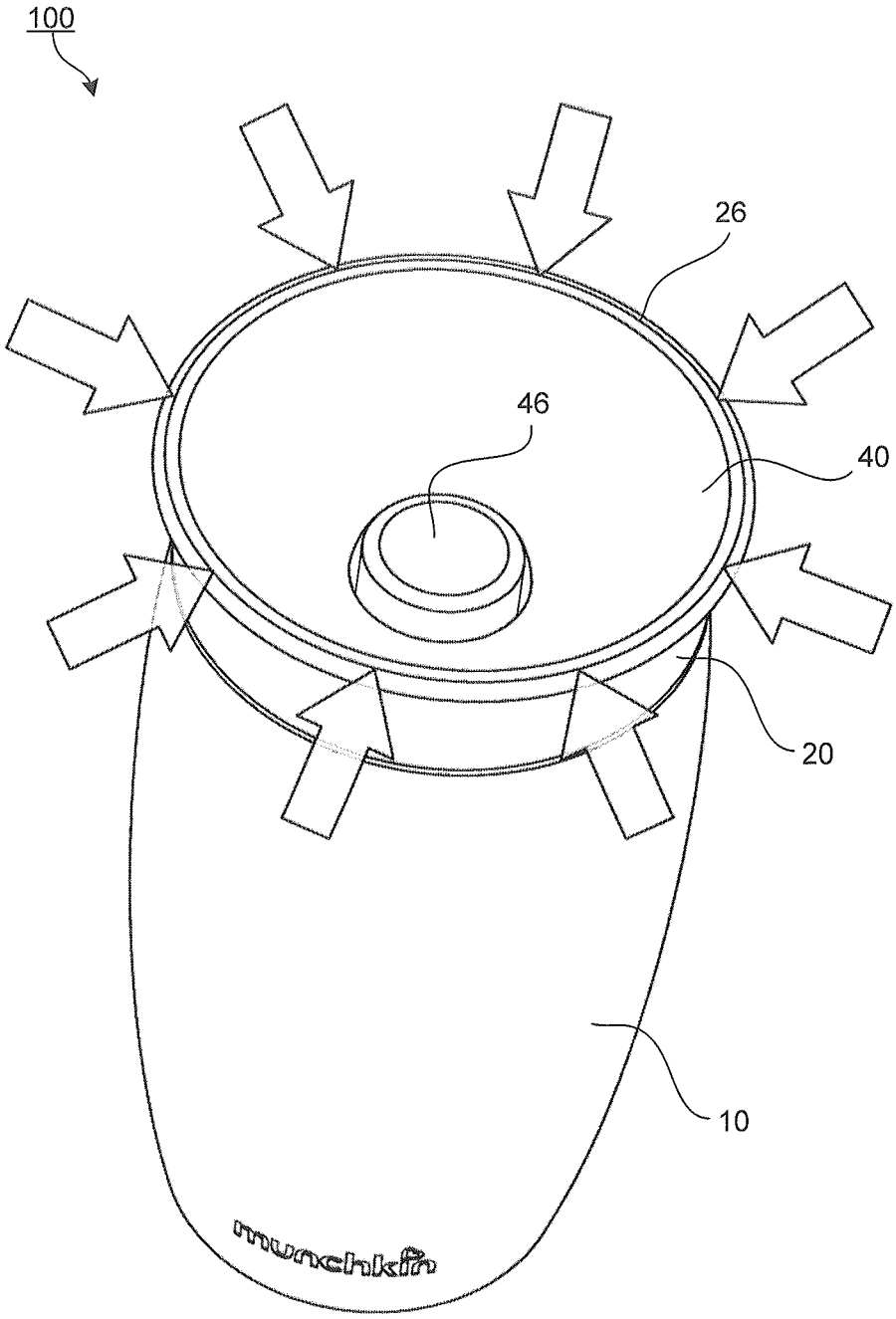
FIGS. 4 and 5 show upper perspective views of the non-spill container assembly capable of being consumed from any angle along its rim according to the subject disclosure.
Figure 5:
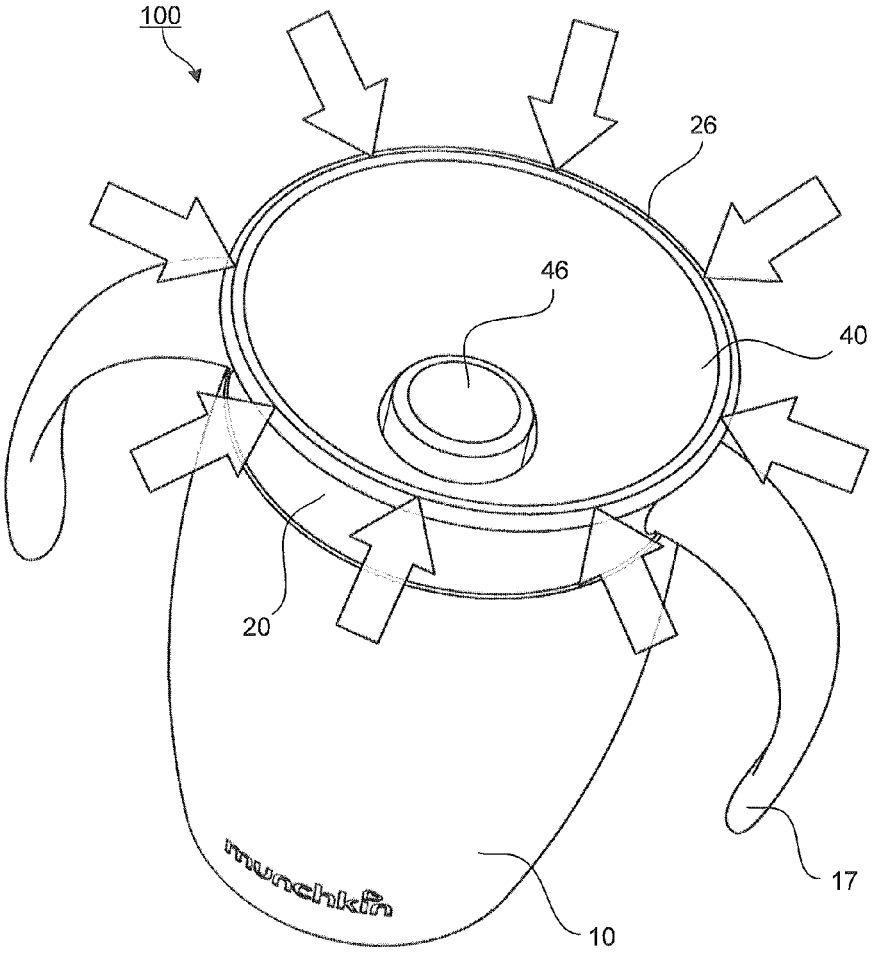

FIGS. 4-5 depict one of the advantages of this drinking container assembly 100. That is, according to this subject disclosure, a user is able to drink from the rim 26 of the drinking container assembly 100 at any location (as shown by the arrows) concentrically around the rim 26 of the top end of the collar 20. For a young child, drinking from this container 100 simulates the idea of drinking from a regular adult drinking cup since it does not include the conventional construction of a protruding spout as its non-spill valve assembly.

Figure 6:
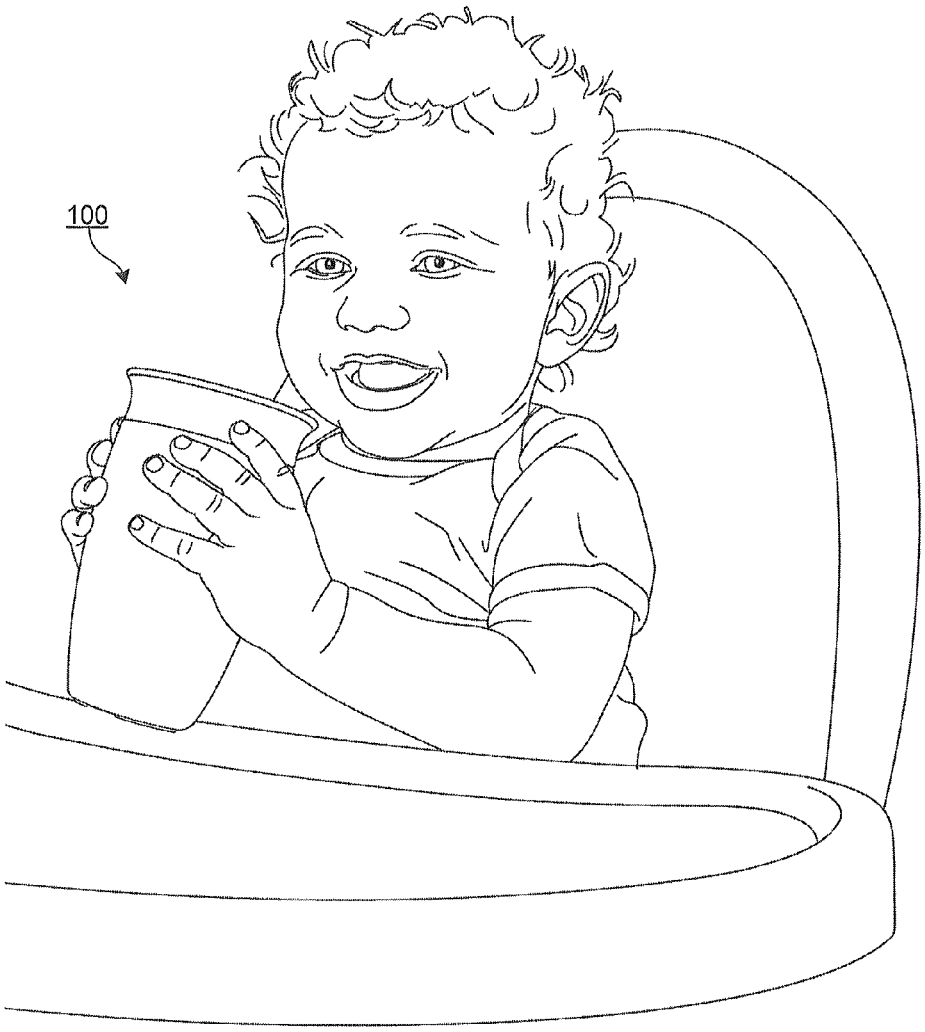
FIGS. 6-7 depict infants comfortably handling the non-spill container assembly while in use.

As shown in FIGS. 6-7, the container assembly 100 is particularly useful and beneficial for a young child transitioning from a bottle to a regular cup container. During this transition, the toddler can conveniently place their lips at any point against the rim 26 of the collar 20 and can draw fluid from any position along the rim 26, as would an adult with a conventional cup. Positive reinforcement of the use of the spill-proof container assembly 100 encourages the confidence and the child's ability to move into using a conventional cup. Although shown used with young children, it is to be understood that the non-spill container assembly 100 may be used by any individual at any age.

FIG. 8 depicts a detailed cross section view of a portion of the non-spill drinking container assembly 100. As shown, the fastener assembly includes male threads 24 disposed at the lower end 23 of the collar 20 being threadedly attached to the female threads 16 provided about an inner surface at the upper end 13 of the container 10. The threaded connection between the container 10 and the collar 20 is fluidly sealed by the resilient sealing ring 11 disposed between the concentric shoulder 15 and the upper end 13 of the container 10 to prevent any leakage of fluid contained within the container 10.

Figure 9:
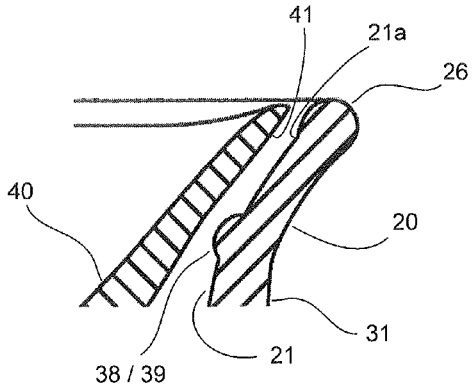
FIG. 9 illustrates an exploded cross section view of the inward collar surface edge of the collar and the inward sealing surface edge of the annular seal.

As shown in a partially enlarged view in FIG. 9, the collar 20 may be constructed to include an outer wall 31 whose upper end terminates at the upper rim 26. Just below the upper rim 26, an abutment or supporting surface 21*a* is provided on an inward facing collar surface edge of the collar 20 juxtaposed to the inward facing sealing edge 41 is adapted to come into sealing engagement with the inward facing sealing edge 41 of the annular seal 40. As shown, FIG. 9 depicts an unsealed open configuration between the supporting surface 21*a* at the inward facing collar surface edge of the collar 20 and the inward facing sealing edge 41 of the annular seal 40 in which a fluid is allowed to flow out of the container 10 as will be shown in more detail in FIG. 10.

The lower end 23 of the collar 20 defines the lower cylindrical wall with a smaller diameter having male threads 24 disposed on an outer surface thereof. The collar 20 may be constructed as a frustoconical support member covering a central opening of the upper end 13 of the container 10. In general, various walls extend inwardly from a concentric inner surface 21 of the collar to an internal lower wall 33 that covers the central portion of the opening 13 to the container 10.

Adjacent to the rim 26 disposed proximal to the upper end 26*a* of the collar 20, the upper end 26*a* of the collar 20 forms an outwardly flared contour. An intermediate lower wall 32 extends radially inward in a downwardly stepped fashion defining the central internal lower wall 33 over the opening 13 in the container 10. The lowermost internal lower wall 33 is positioned at a substantially central position within the collar 20 and over the opening 13.

In other words, the lower wall 33 expands radially outward from a base 28 of a projection 27 to a peripheral edge 33*a*. The projection 27 may be positioned substantially central to the collar 20 opening. An intermediate wall 32 extends radially upward from the peripheral edge 33*a*, outward and away from the lower wall 33 at a predetermined angle towards a second radial ledge 37. The radial ledge 37 then expands radially outward a predetermined distance into the concentric inner surface 21. The concentric inner surface 21 extends upward and flares outward toward the upper end 26*a* of the collar 20 and terminates at the rim 26.

The projection 27 extends upward from the internal lower wall 33 at the central position in the collar 20. The projection 27 includes an upward post 28 that terminates to define an upright mushroom-shaped bulbous head 29. Outer edges 30 of the bulbous head 29 extend radially outward beyond an outer surface of the post 28. The outer edges 30 of the bulbous head 29 define a concentric shoulder 30 that extends radially outward beyond an outer surface of the post 28. The projection 27 may be made as a single integrated part of the lower wall 33 or can be made as a separate part and permanently attached to the lower wall 33. The projection 27 may be secured to the lower wall 33 in a variety of different ways, such as by securely over-molded onto the lower wall 33 and/or any other suitable manner.

As shown in FIG. 8, the projection 27 may include a vent hole 36 to allow air to vent from an external environment back into the drinking container assembly 100 when a negative vacuum pressure has built up inside of the container assembly 100. The vent hole 36 may be aligned with, and in fluid communication with a one-way air check valve aperture 42 provided in the annular seal 40 as will be discussed in more detail later.

The lower wall 33 of the collar 20 radially expands outward laterally from the base of the central projection 27 to a first predetermined radial position over the opening 13*a* of the container 10. The lower wall 33 turns at an angle at the first predetermined radial position and extends radially upward along an intermediate wall 32 toward an outer end of the collar 20 to a second predetermined radial position. At this second position, the collar 20 further expands radially outward at a second radial ledge 37 to the concentric inner surface 21 of the outer wall 31 of the collar 20.

The concentric inner surface 21 of the outer wall 31 extends upward and away from the second radial ledge 37 towards the outwardly flared rim 26. The concentric inner surface 21 may be constructed to curve outwardly along an arc of a predetermined radius.

FIGS. 8 and 9 show protrusions 38 on the supporting surface 21*a* at the inner collar surface edge of the collar 20 adjacent to the rim 26. A plurality of evenly spaced raised protrusions 38 and adjacent gaps 39 are provided concentrically along the upper end of the collar 20 to ensure that the flow of fluid from inside of the container 10 can freely flow between the inward sealing surface edge 41 of the annular seal 40 and the supporting surface 21*a* at the inner collar surface edge of the collar 20 of the container assembly 100. The spaced raised protrusions 38 and adjacent gaps 39 form a fluid communication pathway through which the fluid may flow from inside of the container 10 outward from the annular seal 40.

The height of the raised protrusions 38 and gaps 39 are constructed to optimize the amount of minimum suction force required by the user to lift the outermost radial edge 45 of the annular seal 40 resting against the supporting surface 21*a* at the upper inward collar surface edge of the collar 20 away from the collar 20 so that the seal can be broken without undue difficulty when a suction force is applied by the user. The height of the raised protrusions 38 can be varied to vary the amount of suction force required to break the seal and lift the outermost radial edge 45 away from the supporting surface 21*a*.

Figure 10:
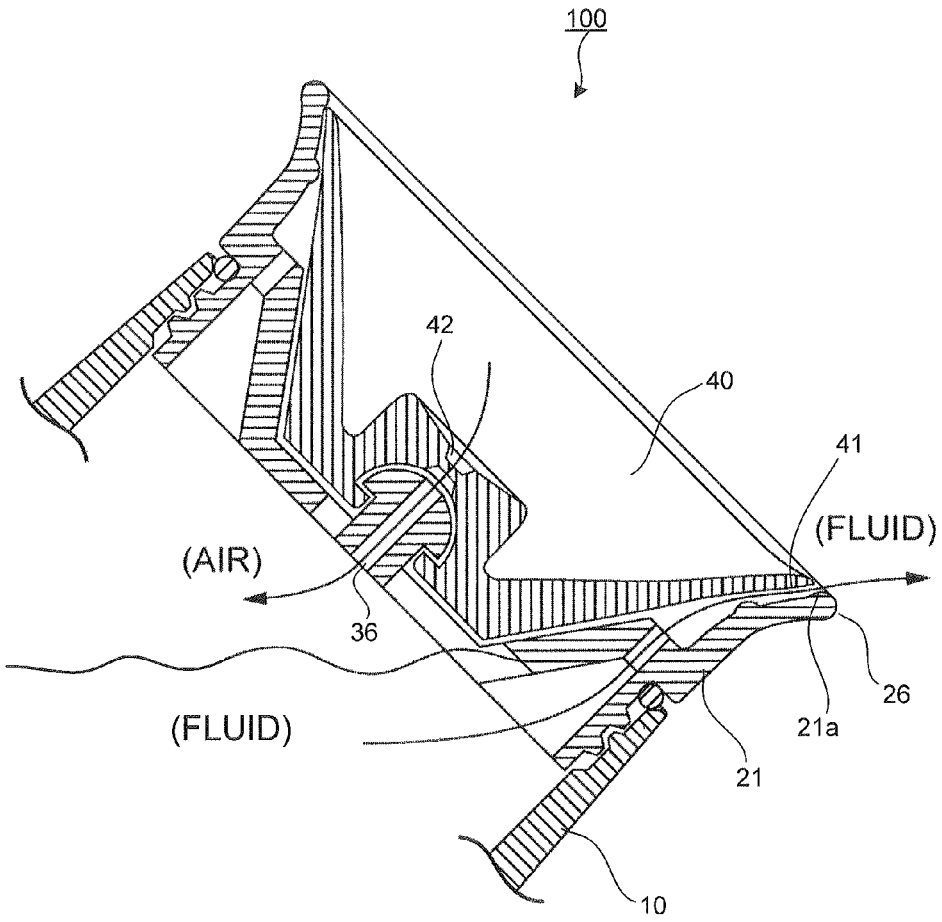
FIG. 10 depicts a cross section view of the upper end of the non-spill container assembly in use.

FIGS. 8 and 10 show the instance when a suction force is applied with a predetermined negative suction pressure to the rim 26 of the collar 20, the inward sealing surface edge 41 of the annular seal 40 will be lifted under the suction force with enough height to break the seal and allow the liquid to flow through the gaps 39 constructed on the supporting surface 21*a* and the lifted inward sealing surface edge 41 of the annular seal 40 on the inner surface of the rim 26.

Figure 11:
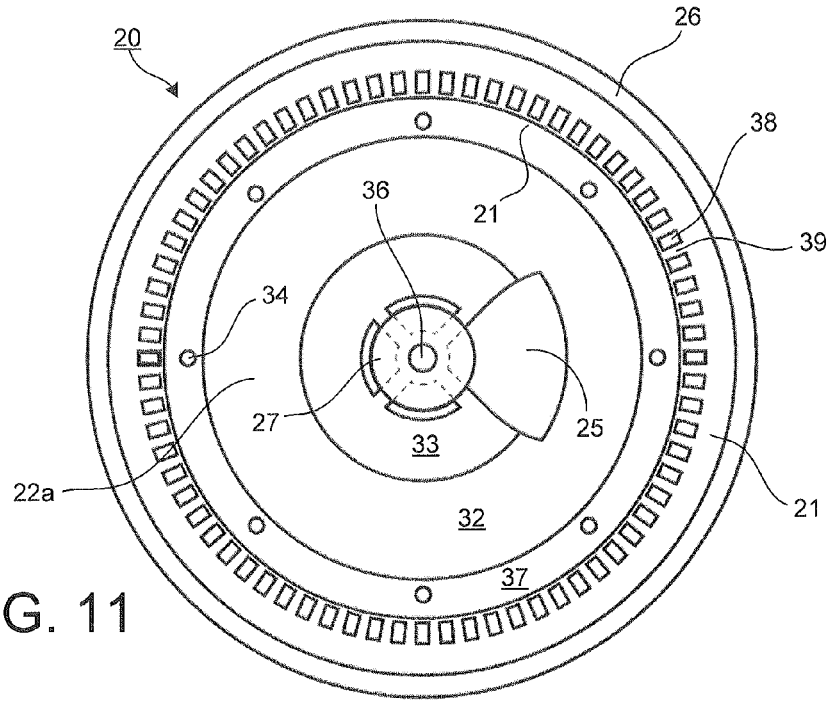
FIG. 11 illustrates a top view of an exemplary collar.

FIGS. 8 and 11 show a plurality of radially apertures 34 disposed concentrically on the collar 20. The radial apertures 34 create various passageways to allow the fluid in the container 10 to flow out of the container 10 and through the collar 20 into a reservoir cavity 35 provided above the apertures 34 and below the inward sealing surface edge 41 of the annular seal 40. The various apertures 34 may be constructed of a variety of different sizes and/or shapes. For example, the apertures 34 may be made smaller to reduce the flow rate of the fluid exiting from the container 10. Likewise, the apertures 34 may be made larger to increase the flow rate of the fluid exiting from the container 10. Alternatively, in a single container, the apertures 34 may be varied, some may be smaller and/or larger to selectively vary the flow rate of the fluid exiting from the container 10.

At least one air vent aperture 36 is provided in the collar 20 to allow the venting of air from the external atmosphere back into the container assembly 100. Entry of the air from the external atmosphere will allow the pressure within the container 10 to come to an equilibrium state with the pressure outside of the container assembly 100 as the user sucks fluid out from within the container 10. As the user sucks the fluid out of the container a negative vacuum pressure is created within the container assembly 100 that causes the air from the external environment to be drawn into the container 10 through a one-way air valve 42 and the vent hole 36.

The annular seal 40 is constructed to be disposed over the collar 20, opposite the container 10. The annular seal 40 has a frustoconical shape constructed similar in shape to a suction cup. The fluid seal between the annular seal 40 and the collar 20 occurs between the outermost radial edge 45 and the supporting surface 21*a* at the inward facing collar surface edge adjacent to the rim 26 of the collar 20. As shown in FIG. 8, the lower end of the frustoconical shape of the annular seal 40 substantially mirrors the upper side of the inner frustoconical shape of the collar 20. In position, the annular seal 40 attaches to and substantially butts up against an upper portion of the collar 20 of the container assembly 100 to form a seal.

A recess 43 is provided in a lower side surface of the annular seal 40 that faces the upper surface of the collar 20. A concentric flange 44 extends inwardly at the entry end of the recess 43 in the annular seal 40 in order to provide an engagement and locking mechanism to attach to a concentric shoulder 30 defined by the bulbous head 29 of the projection 27. That is, the recess 43 of the annular seal 40 is pushed down over the bulbous head 29 until the concentric flange 44 slides over the bulbous head 29 and locks onto the concentric shoulders 30 below the bulbous head 29.

Figure 12:
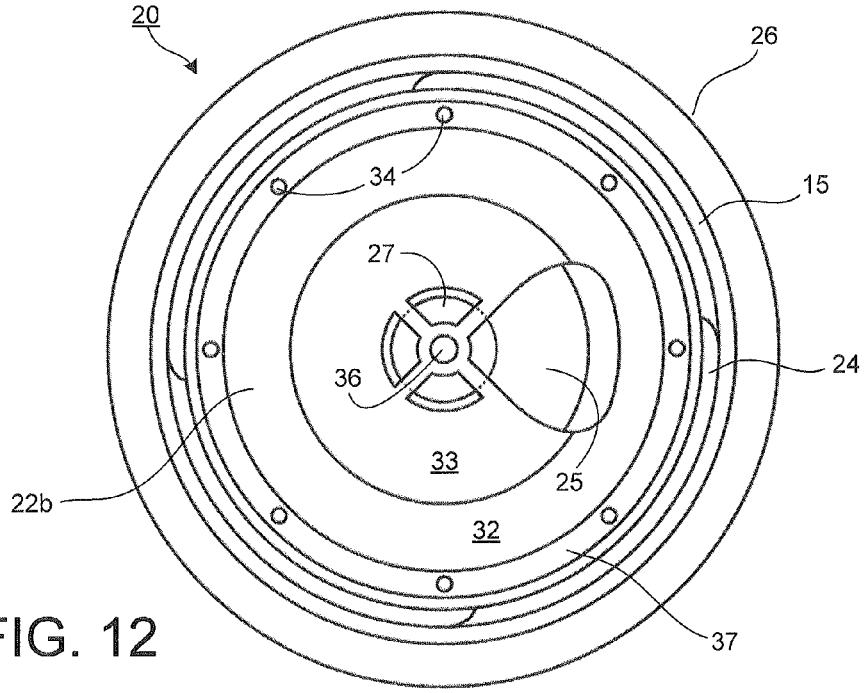
FIG. 12 shows a bottom view of the collar.

FIG. 12 shows a bottom view of the collar 20. As shown in FIGS. 8 and 12, an off-center opening 25 is provided in the lower wall 33 and partially disposed in the intermediate wall 32. The off-center opening 25 is provided to enable a user to insert (such as with a finger) through the off-center opening 25 from below to push the annular seal 40 off of, and away from the projection 27. In this way, a user can efficiently disassemble the component parts of the container assembly 100 and thoroughly clean the various components in the container assembly 100.

An advantage of providing the off-center opening 25 is for the user to be able to push their finger against a thicker portion of the annular seal 40 that can endure the repetitive pushing without causing damage to other sensitive portions of the annular seal 40 which could jeopardize the sealing capabilities of the annular seal 40 itself. For example, pushing against the annular seal 40 adjacent to the one-way air vent aperture 42 or pulling against the inward sealing surface edge 41 of the annular seal 40 can potentially permanently deform and/or tear the annular seal 40 at various locations. Some of those sensitive locations being the concentric flange 44, the inward sealing surface edge 41 and/or the one-way air vent aperture 42 which could rupture its sealing capabilities.

Referring back to FIG. 8, the annular seal 40 includes a one-way air valve 42 that communicated with the vent hole 36. The one-way air valve 42 is adapted to allow air to pass from the external environment through the annular seal 40 and into the air vent hole 36. The air vent hole 36 is in fluid communication with an internal volume within the container 10 into which the fluid is stored. As will be described later, a one-way air valve(s) may be provided in a variety of different locations to communicate with a vent hole 36 that can also be disposed in a variety of different locations on the collar 20.

FIG. 10 depicts the container assembly 100 in operation. In use, when the user has tipped the rim 26 of the container assembly 100, over toward their lips, the fluid within the container 10 flows through the radially disposed apertures 34 in the collar 20 and collects in the reservoir cavity 35 adjacent to the upper end of the annular seal 40. As the user sucks at the edge of the container assembly 100, the inward sealing surface edge 41 of the annular seal 40 is lifted off of the supporting surface 21*a* at the concentric inner surface of the collar 20 and the fluid inside of the container 10 is allowed to be drawn out of the container assembly 100 under the suction force applied to the rim of the container assembly 100. That is, the internal pressure within the container assembly 100 is reduced and a vacuum is created inside of the container assembly 100 relative to the atmospheric pressure outside of the container assembly 100. As a result, atmospheric air is drawn into the container assembly 100 through the one-way air valve 42 and back into the container assembly 100 through the vent hole 36 located in center of the annular seal 40 and the collar 20 respectively in an attempt to reestablish an equilibrium pressure state between the internal pressure within the container assembly 100 and the atmospheric pressure surrounding the container assembly 100.

Referring back to FIG. 8, the material construction of the annular seal 40 surrounding the projection 27 may be substantially built up and/or thickened, as shown by the thickened raised portion 46 surrounding the projection 27, to provide the rigidity necessary to enable the interior cavity defined by the recess 43 and the concentric flange 44 to securely receive, hold and lock onto the extended outer edges 30 of the projection 27. The raised portion 46 is substantially large enough to comfortably support a finger, such as a thumb depressing downward the raised portion 46 onto and over the projection 27. The raised portion 46 may take various ergonomically comfortable configurations suitable to receive various parts of a user's hand.

FIGS. 11, 13-15, 18-19, 22-23, 25 and 28 depict various views of the upper end of the non-spill container assembly 100 including a collar 20 and an annular seal 40 having a plurality of raised protrusions 38 and gaps 39. The raised protrusions 38 and gaps 39 are disposed concentrically on either an underside of the annular ring 40 or on an inward sealing surface edge 41 of the annular seal 40 or the supporting surface 21*a* of the collar 20. It is to be understood that the raised protrusions 38 and gaps 39 may be interchangeably located on the inward sealing surface edge 41 of the annular seal 40 or integrated as part of the supporting surface 21*a* of the collar 20 as shown in FIGS. 8, 17-19, 22-23, 25 and 28. The raised protrusions 38 and gaps 39 define various channels through which the fluid within the container 10 may flow out of an opening between the inward sealing surface edge 41 of the annular seal 40 and the supporting surface 21*a* of the collar 20.

Figure 13:
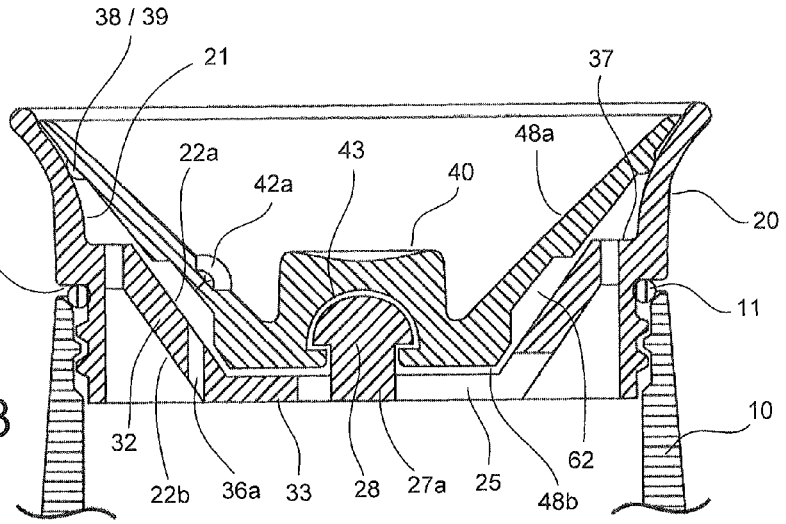
FIG. 13 depicts a cross section view of the upper end of the non-spill container assembly having a plurality of raised protrusions and gaps disposed on an underside of an annular seal.
Figure 14:
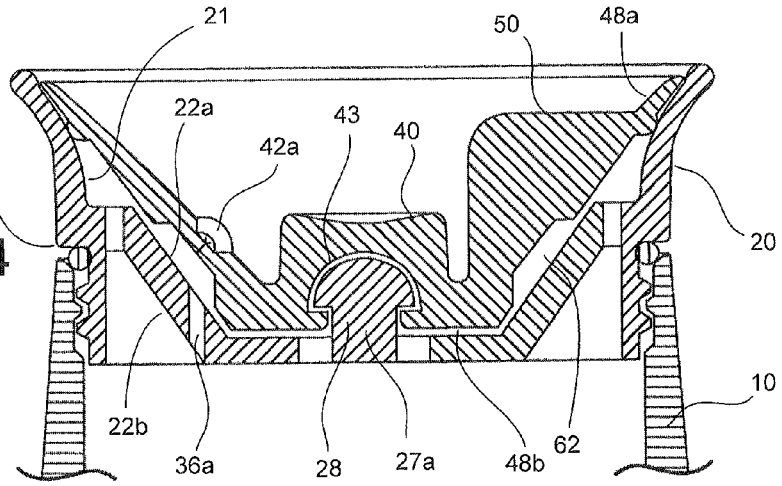
FIG. 14 illustrates a cross section view of the upper end of the non-spill container assembly having a pull tab for removing the annular seal from the secure position over the projection.
Figure 15:
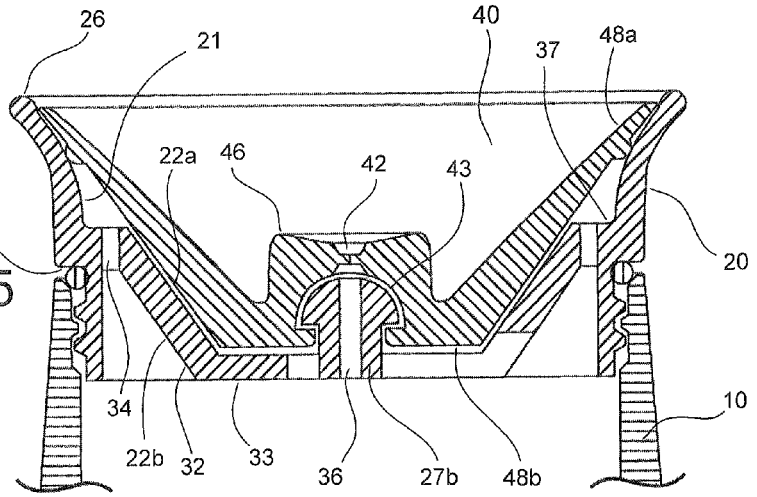
FIG. 15 shows a cross section view of the upper end of the non-spill container assembly having a through passage disposed through the annular seal and the collar.
Figure 16:
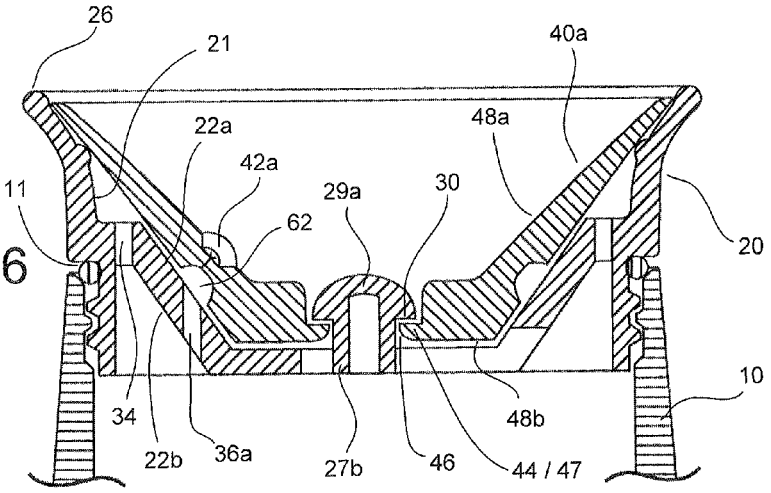
FIG. 16 depicts a cross section view of an air vent passage disposed offset from the center of the non-spill container assembly.
Figure 22:
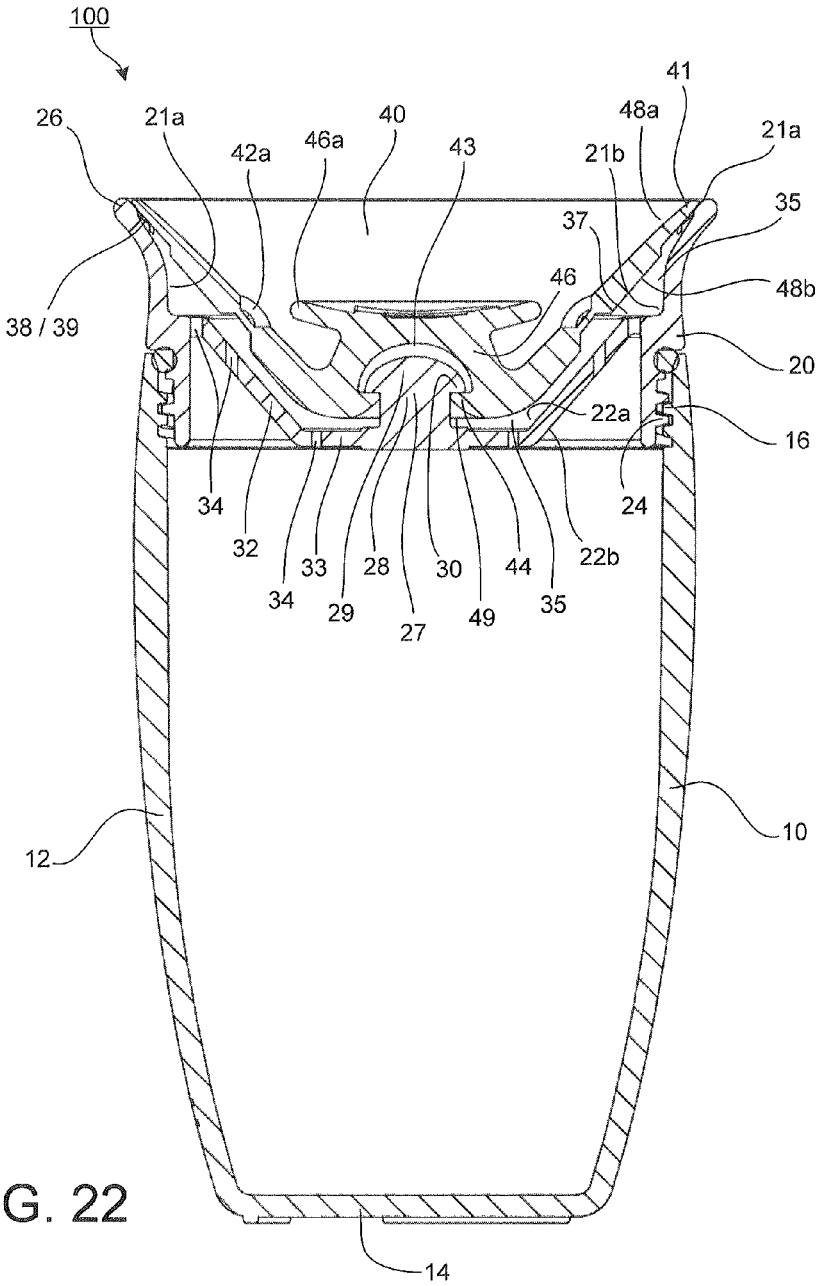
FIG. 22 depicts a cross section view of the non-spill container with an annular seal having an extended flange.

FIGS. 13-16 and 22 show various configurations for the projection 27. In particular, the projection 27 may be embodied as solid projection 27*a* structure as shown in FIGS. 13-14 and 22, or as a partially hollowed projection 27*b* having an open structure as shown in FIG. 15, or a recessed hollow closed structure as shown in FIG. 16. As before, the various projections 27*a*, 27*b* are constructed to be disposed and fastened within a recess 43 in the annular seal 40 as described above.

In FIGS. 13-14, 16 and 28, an air vent aperture 36*a* may be provided offset from an axial center of the container assembly 100 to allow air to vent from an external environment back into the drinking container assembly 100. As shown, the air vent apertures 36*a* are provided offset from the center of the collar 20. For example, and as shown in FIG. 16, the air vent aperture 36*a* may be provided in intermediate wall 32 and a one-way air vent valve aperture 42*a* may be aligned with and in fluid communication with the air vent aperture 36*a* to allow the entry of air in from the external atmosphere. The lower end of the annular seal 40 may include various channels 44 as shown in FIGS. 13-14 and 16. The channels 44 may be concentric and may be provided in fluid communication with the air vent aperture 36*a* and the one-way valve aperture 42*a*. One of more air vent aperture 36*a* may be provided around the center of the container assembly 100. As shown in FIG. 22, the radially disposed apertures 34 may be optimally positioned to function as the air vent apertures 36*a* in which the radially disposed aperture 34 is positioned below the one-way air vent valve aperture 42*a* to fluidly communicate with atmospheric air outside of the container assembly 100 when a vacuum is built up with in the container assembly 100.

FIG. 14 illustrates a cross section view of the upper end of the non-spill container assembly 100 having an upwardly extended pull tab 50 constructed into the upper surface of the annular seal 40. The upwardly extended pull tab 50 is adapted for removing the annular seal 40 from the secure position over the projection 27. The pull tab 50 is sufficiently pronounced and extends a predetermined distance above the upper surface of the valve 40 to receive a user's finger to grab onto the pull tab 50 and pull up with enough force to lift the annular seal 40 from the projection 27*a* of the container assembly 100.

FIG. 16 shows an alternative embodiment in which the annular seal 40*a* is provided with a central aperture 46. A concentric flange 44 defines an undercut shoulder 47 provided at the central aperture 46. In use, in order to engage and lock the annular seal 40*a* onto and over the bulbous head 29*a* of the projection 27*b*, the concentric flange 44 of the central aperture 46 of the annular seal 40*a* is pushed down over the bulbous head 29 until the concentric flange 44 slides over a mating concentric shoulder 30 extending outward from the bulbous head 29*a* and locks its undercut shoulder 47 onto the extended concentric shoulder 30 below the bulbous head 29*a*.

Figure 17:
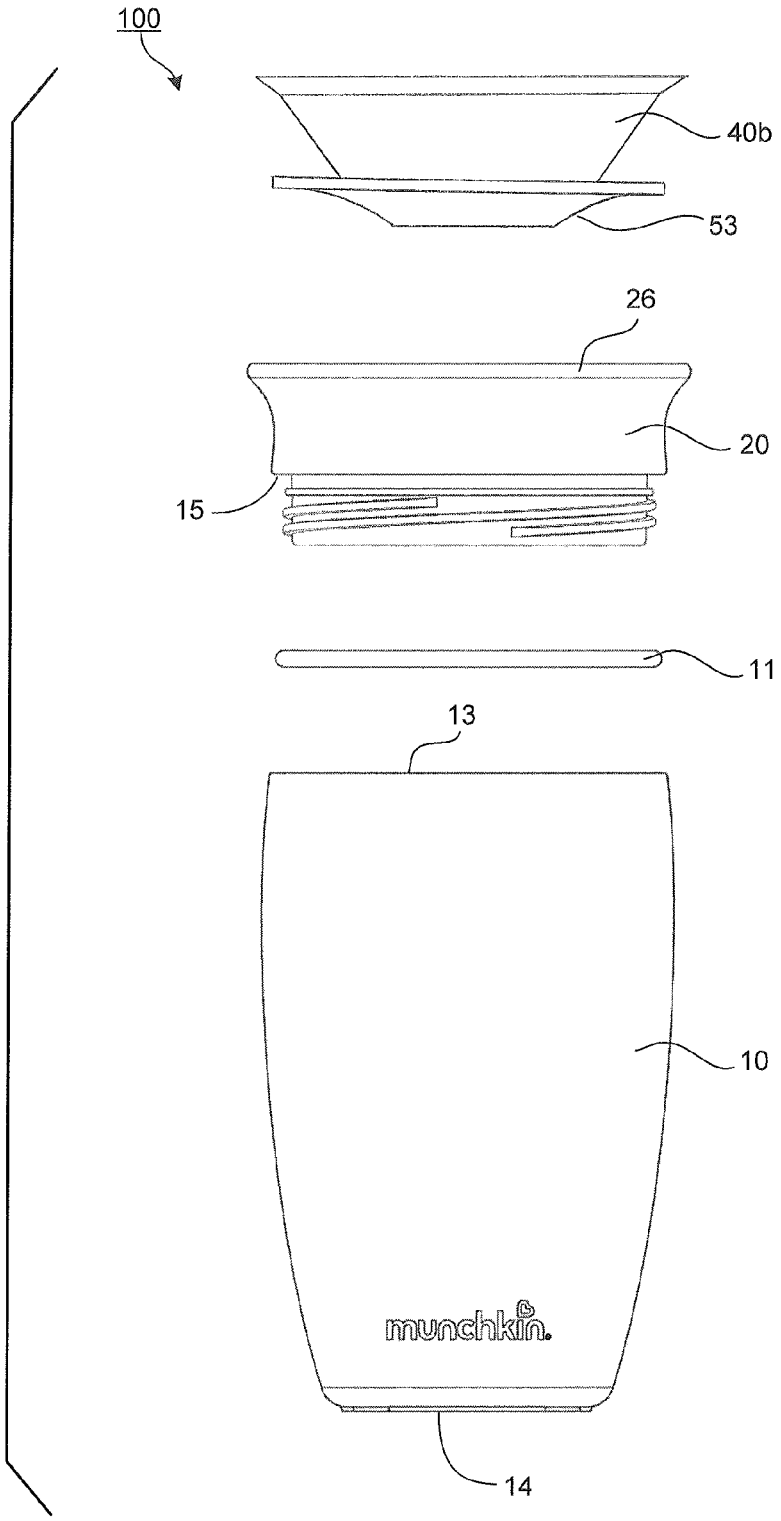
FIG. 17 illustrates an exploded view of a non-spill container assembly having another exemplary annular seal according to the subject disclosure.

FIG. 17 depicts an exploded view of a non-spill container assembly 100 having another exemplary annular seal 40*b* according to the subject disclosure. The annular seal 40*b* is positioned and secured within the container assembly 100 between the collar 20 and the container 10 as shown in FIGS. 18-19.

Figure 18:
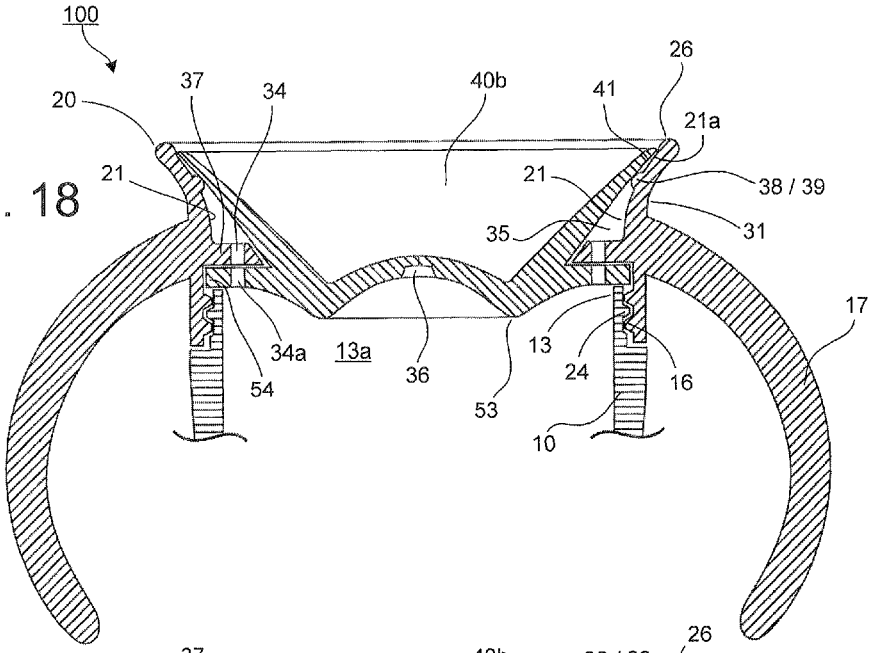
FIGS. 18-19 show a cross section view of the upper end of the non-spill container assembly in FIG. 17 having raised protrusions and gaps disposed on the annular seal and on the collar, respectively.
Figure 19:
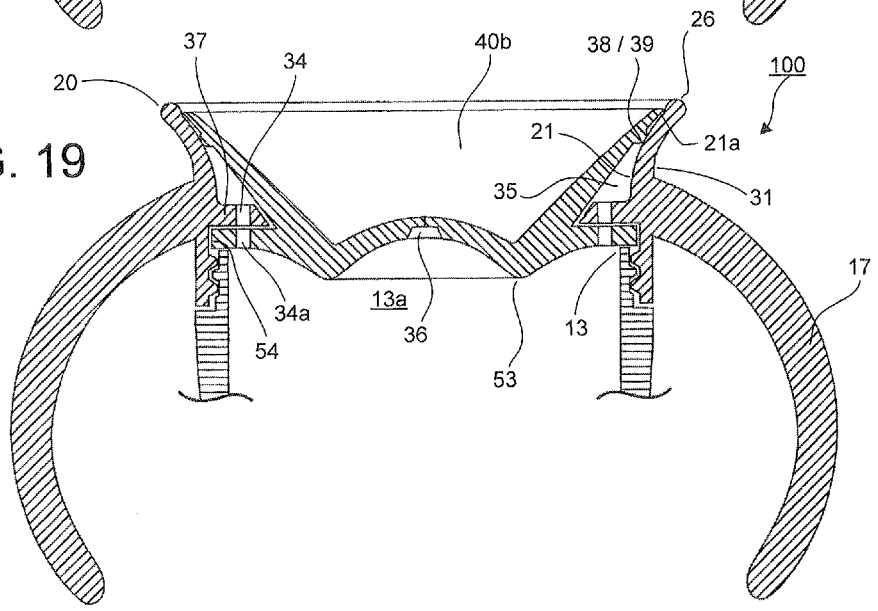

FIGS. 18-19 show the annular seal 40*b* secured between an inward projecting ledge 37 and an upper open end 13 of the container 10. The annular seal 40*b* also includes various raised protrusions 38 and gaps 39 disposed between the supporting surface 21*a* of the collar 20, and the inward sealing surface edge 41 of the annular seal 40, respectively. In one instance shown in FIG. 18, the raised protrusions 38 and gaps 39 are integrated onto the annular seal 40*b*. As shown in FIG. 19, the raised protrusions 38 and gaps 39 are integrated onto the supporting surface 21*a* at the inward collar surface edge of the collar 20. As shown in FIGS. 18-19, the male 24 and female 16 threads may be reversed to effect a secure mating connection between the container 10 and the collar 20.

As shown, the collar 20 includes a side wall 31 with a pair of handles 17 extending there from. As before, the collar 20 also includes an inward projecting ledge 37 that extends from the inward facing collar surface wall 21 of the collar 20. Fluid passages 34 are disposed in the projecting ledge 37 and are adapted for alignment with fluid passages 34*a* in a concentric outermost end wall 54 extending from a lower wall 53 of the annular seal 40*b*. Fluid in the container 10 may flow out of the container 10 through the fluid passages 34 and 34*a* and into the reservoir cavity 35 between the annular seal 40*b* and the collar 20.

The concentric outermost end wall 54 that branches off of and extends from the lower wall 53 of the annular seal 40*b* extends across the upper open end 13*a* of the container 10. The concentric outermost end 54 of the lower wall 53 may be comprised of a leak-proof material capable of sealing the connection between the container 10 and the collar 20 adjacent to the threaded attachment as shown in FIGS. 18-19.

As before, the annular seal 40*b* includes an inward sealing surface edge 41 that applies a sealing pressure against the supporting surface 21*a* at the inwardly facing collar surface edge of the collar 20 to prevent spillage of the fluid from inside of the container 10 when no suction pressure is applied to the annular seal 40. When a suction pressure is applied to any location along the rim 26, the inward sealing surface edge 41 is lifted off of the supporting surface 21*a* at the inwardly facing collar surface edge of the collar 20 so that the fluid within the container 10 may flow out of the container assembly 100.

The concentric outermost end 54 of the annular seal 20*b* and the inward projecting ledge 37 extending from the collar 20 include aligned fluid passages 34, 34*a*. An air vent aperture 36 is provided in the lower wall 53 to allow air to vent from the external environment back into the drinking container assembly 100 when a negative vacuum pressure has built up inside of the container assembly 100.

The size, shape, orientation of the annular seal annular seal 40, 40*a*, 40*b* may be configured in a variety of different ways. The annular seal 40, 40*a*, 40*b* may be constructed of any type of suitable elastic resilient sealing material adapted to provide a leak proof seal between the collar and the annular seal. Likewise, one or more portions of the container assembly 100 may be co-molded to include various materials of various rigidity or strength. For example, the annular seal 40*b* may be comprised of a various resilient materials at different locations along the annular seal 40*b*, such as various durometers at various locations on the annular seal. For example, the inward sealing surface edge 41 and concentric outermost edge 54 may be made from a softer more resilient material and the remainder of the annular flange 40*b*, may be made of a harder resilient material or durometer.

Figure 20:
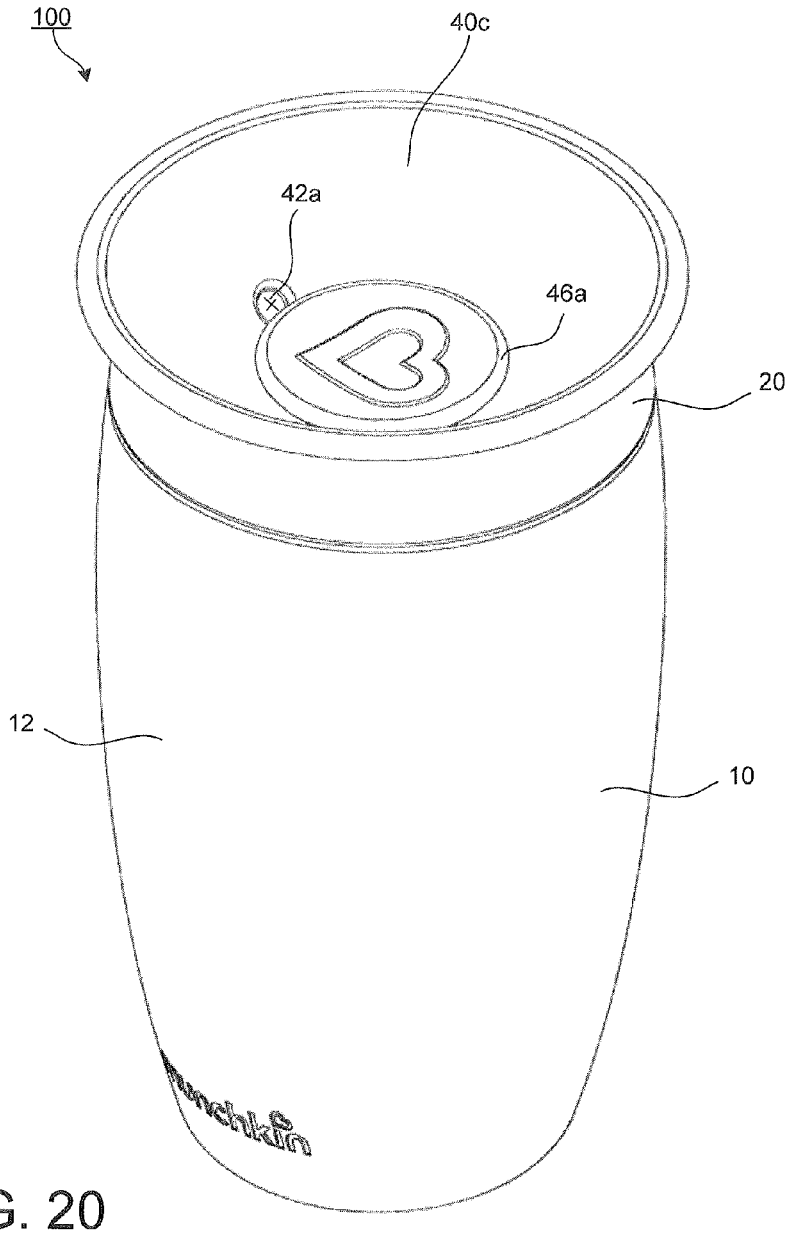
FIG. 20 illustrates another upper perspective view of the non-spill container.
Figure 21:
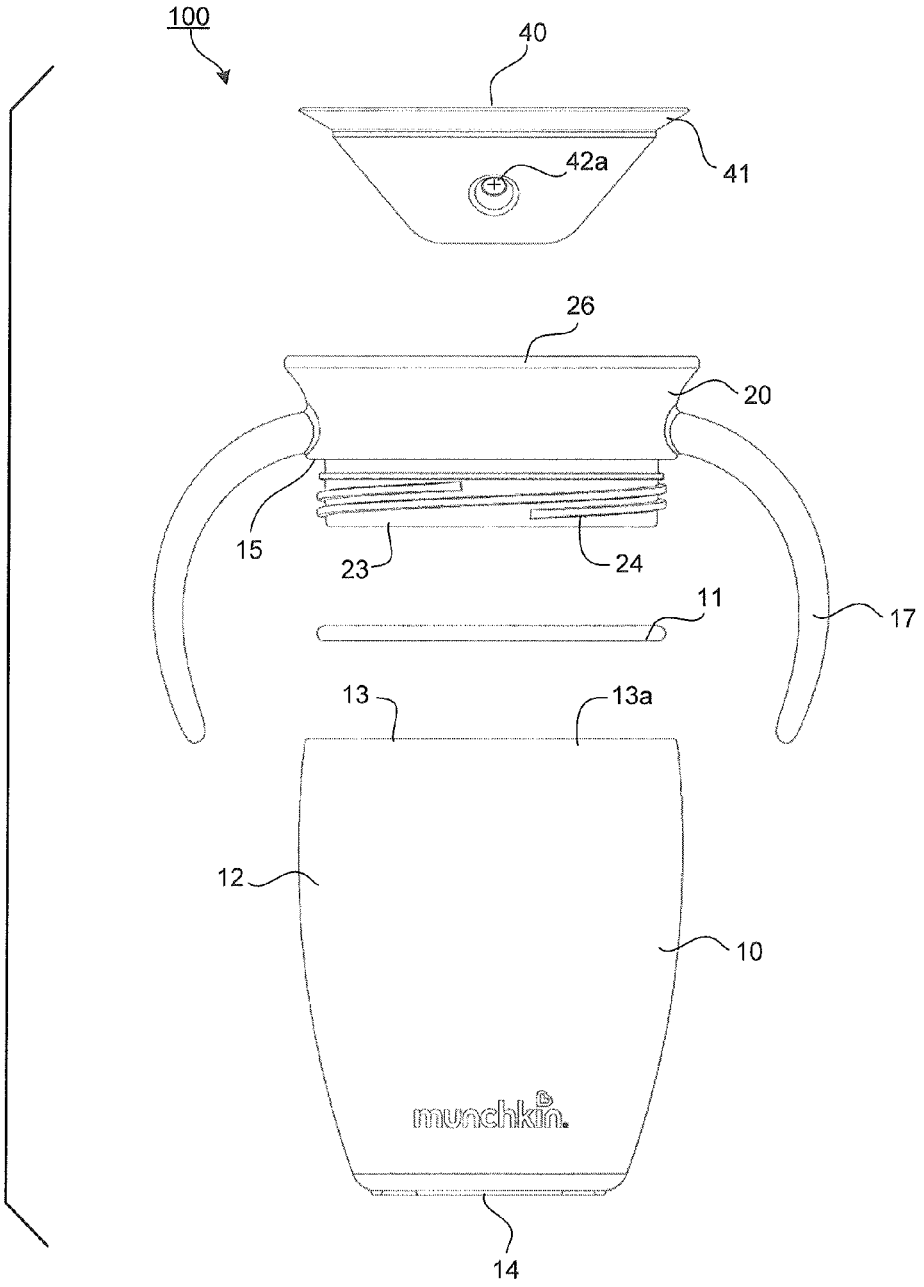
FIG. 21 shows an exploded view of the non-spill container assembly including a collar having a pair of handles.

FIGS. 20, 21 and 22 show another upper perspective, an exploded view and a cross section view of the non-spill drinking container assembly 100. The construction for the container assembly 100 is similar to the embodiments described above and functions similarly with only relatively minor changes.

The annular seal 40*c* includes a projecting raised portion 46 having a radially outward extending flange 46*a* at the uppermost peripheral end of the projecting raised portion 46.

FIG. 22 depicts a cross section of the container assembly 100. As shown in more detail, the collar 20 has an internal frustoconical shape wall. Likewise, the annular seal 40 includes a mating frustoconical shape having an upwardly projecting bulb configuration in the center. Like the frustoconical shape walls of the various previous embodiments, the collar 20 has a circular upper rim 26 end that extends downwardly and inwardly from the rim 26 to a stepped intermediate wall 32. The intermediate wall 32 extends inward to a closed lower wall 33. And, the closed lower wall 33 has a projection 27 that extends outward from its center.

As before, a circular upper rim abutment surface and/or the supporting surface 21*a* is provided at an upper edge of the inward collar surface edge 21 and is adapted to form a fluid seal when an inward sealing edge 41 of the annular seal 40 lies against the supporting surface 21*a* at the inner collar surface edge.

Figure 23:
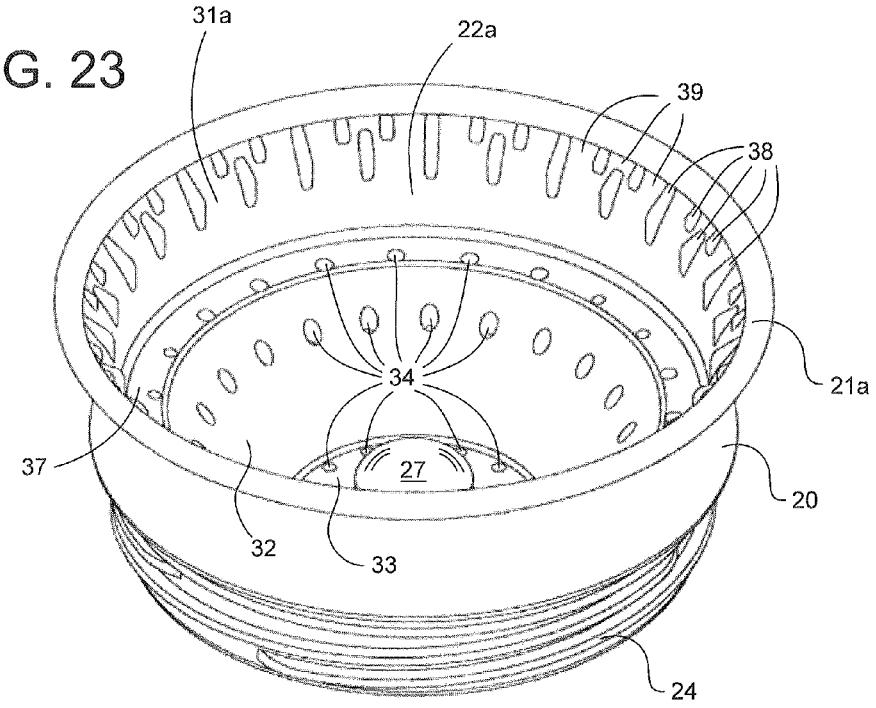
FIGS. 23-24 illustrate upper and lower perspective views of the frustoconical collar of the non-spill container.
Figure 24:
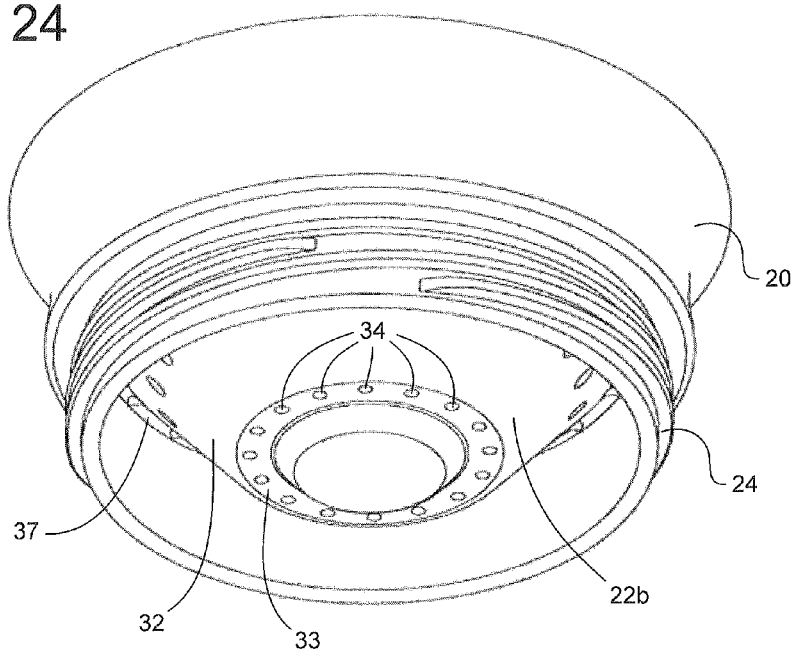
Figure 25:
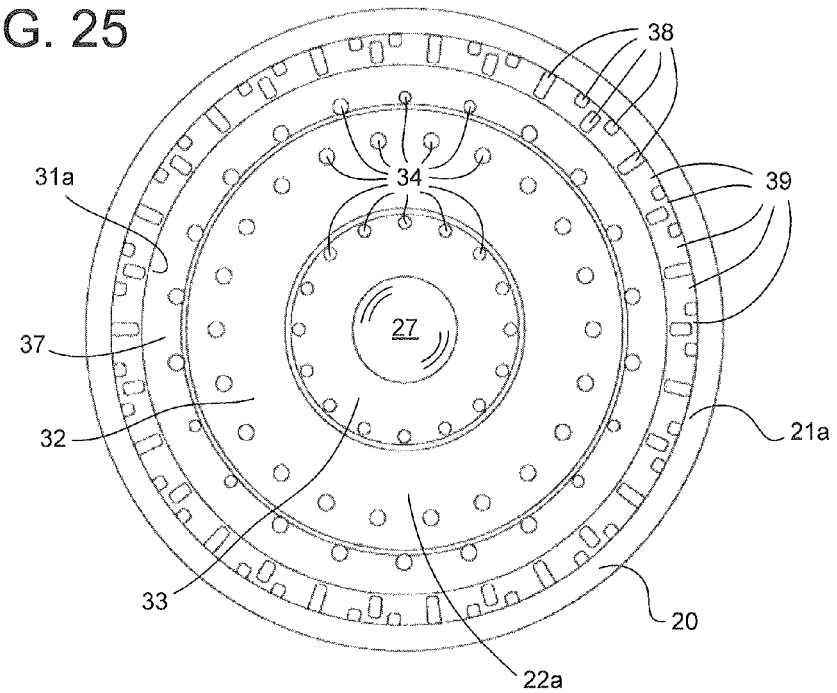
FIGS. 25-26 show top and bottom views of the frustoconical collar of the non-spill container.

As shown in FIGS. 23 and 25, a plurality of raised protrusions 38 and adjacent gaps 39 are disposed radially adjacent to the supporting surface 21*a* defining various fluid channels along the supporting surface 21*a*. Likewise, a plurality of radially disposed apertures 34 are disposed radially around the projection 27 throughout the internal frustoconical shape walls 32, 33, 37 of the collar 20 to allow the fluid in the container 10 to flow out of the container 10 and across the collar 20 into the reservoir cavity 35 provided above the apertures 34 and below the inward sealing surface edge 41 of the annular seal 40*c*.

Figure 26:
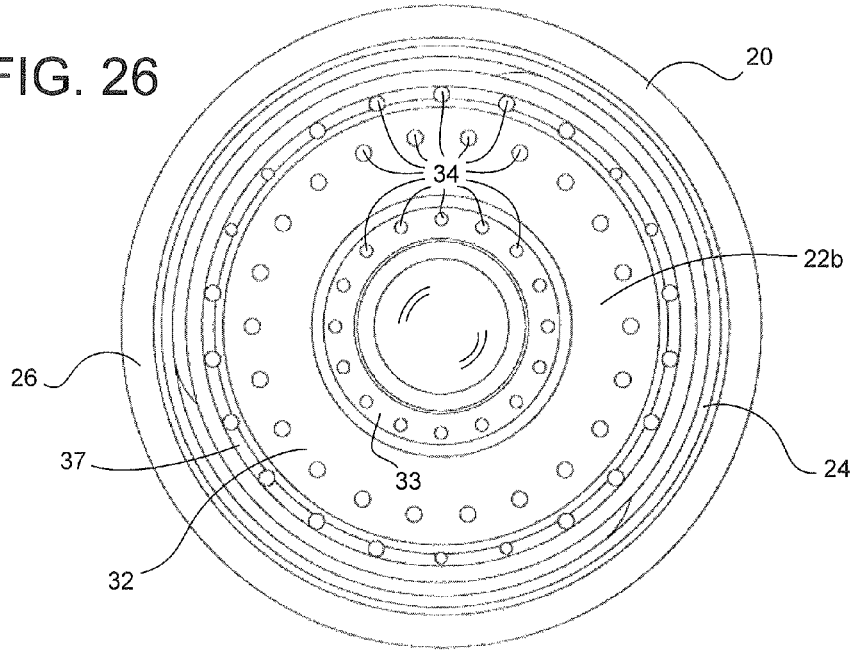
Figure 27:
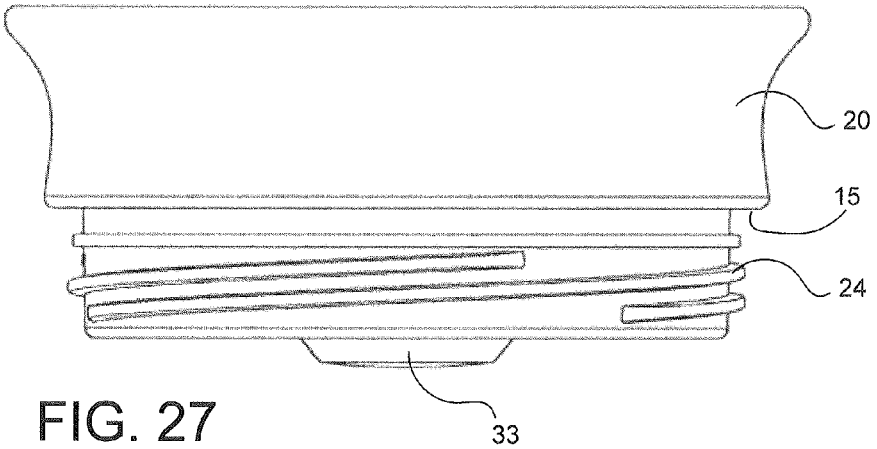
FIG. 27 depicts a side view of the frustoconical collar of the non-spill container according to the subject disclosure.
Figure 28:
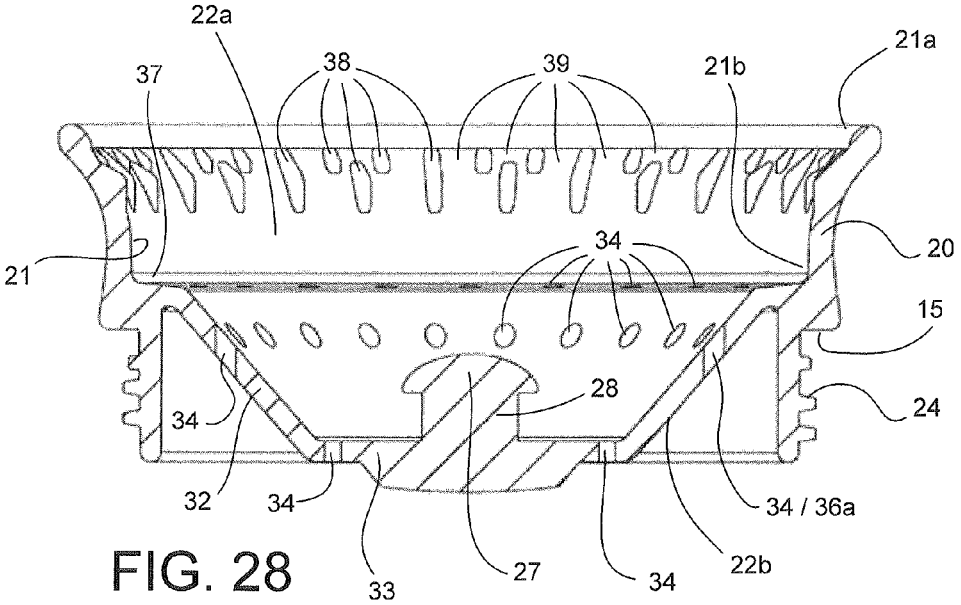
FIG. 28 shows a cross section view of the frustoconical collar of the non-spill container.
Figure 29:
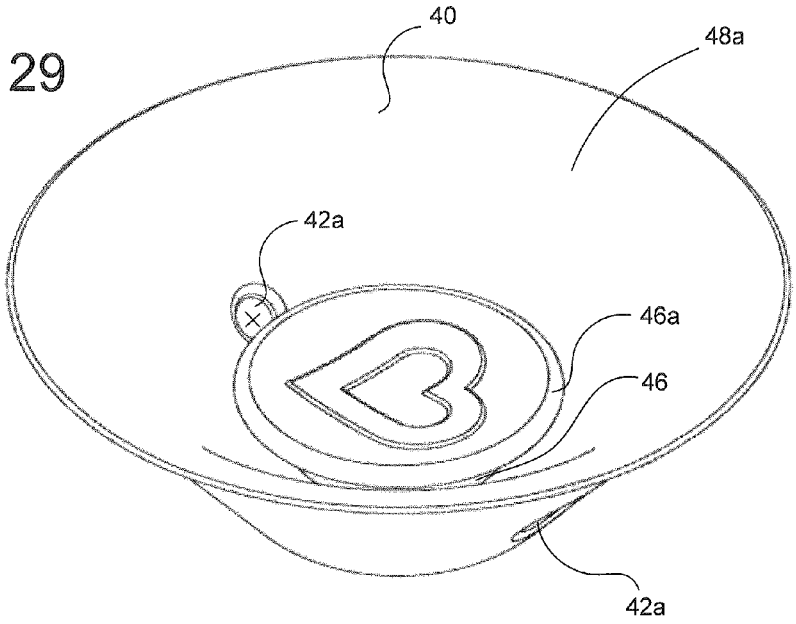
FIGS. 29-30 illustrate upper and lower perspective views of the annular seal of the non-spill container.
Figure 30:
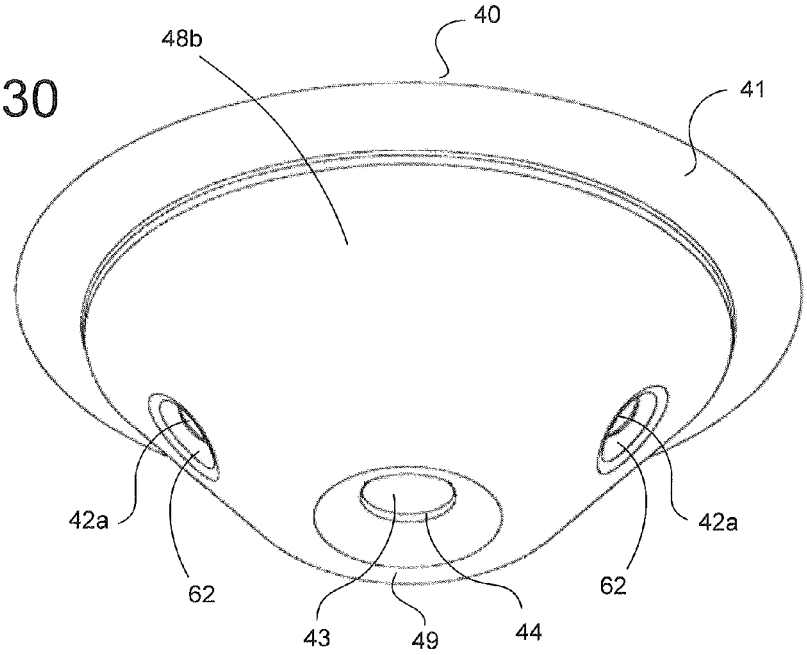
Figure 31:
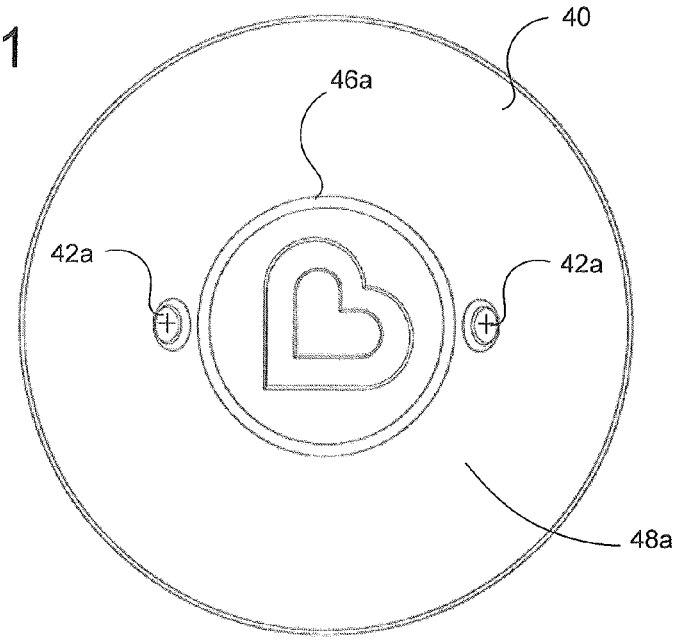
FIGS. 31-32 show top and bottom views of the annular seal of the non-spill container.
Figure 32:
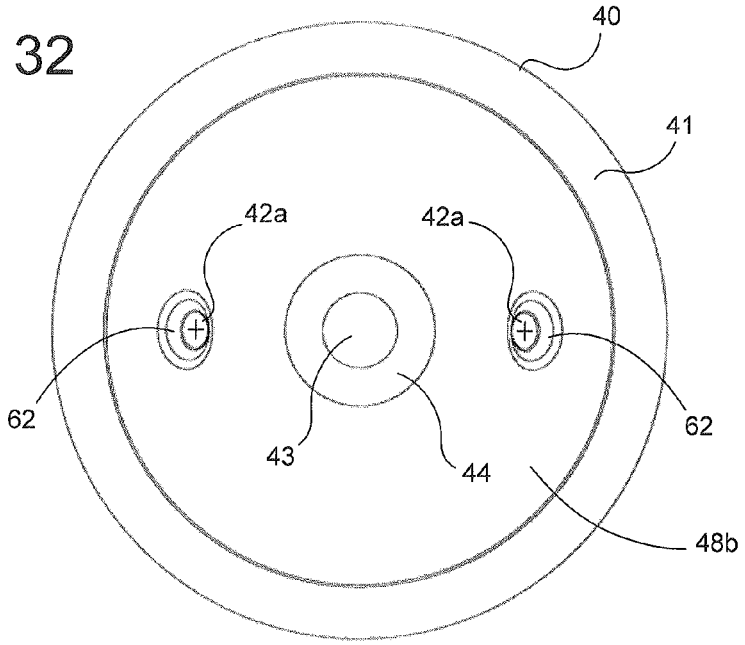

As mentioned previously, the various apertures 34, 34*a* may be constructed of a variety of different size openings and/or shapes. That is, the apertures 34 may be made smaller to reduce the flow rate of the fluid exiting from the container 10. Likewise, the apertures 34, 34*a* may be made larger to increase the flow rate of the fluid exiting from the container 10. Alternatively, in a single container such as shown in FIGS. 25-26, the apertures 34 may be varied in opening size and shape, some may be smaller and/or larger to selectively vary the flow rate of the fluid exiting from the container 10 as the user draws in the fluid by a suction action around the rim 26 of the collar 20.

Various modifications to the structure of the collar 20 and annular seal 40 affect the fluid flow properties of the fluid out of the container assembly 100. For example, the various raised protrusions 38 and adjacent gaps 39 can be raised or lowered and will affect the suction force required to lift the inward sealing surface edge 41 from the inward facing collar surface 20 edge. Likewise, the number and size of the various apertures 34 will affect the flow rate of the fluid out of the container assembly 100. The surface area contact made between the inward sealing surface edge 41 of the annular seal 40*c* and the supporting surface 21*a* of the collar 20 will also affect the amount of suction required to lift the inward sealing surface edge 41 away from the supporting surface 21*a* of the collar 20. Various other features can also affect the use and operation of the container assembly 100.

As shown in FIG. 22, the various apertures 34 also act as an air vent passage to communicate air from a one-way air vent valve aperture 42*a* back into the container 10 of the container assembly 100. The apertures 34 allow the pressure within the container 10 to come to an equilibrium state with the pressure outside of the container assembly 100. That is, after the user has sucked fluid out from within the container 10 and has caused a negative vacuum pressure within the container assembly 100, the apertures 34 allow air to flow back into the container 10 under a negative pressure drawing in air through the one-way air vent aperture 42*a*.

As before, the plurality evenly spaced raised protrusions 38 and adjacent gaps 39 are provided to ensure that the flow of fluid from inside of the container 10 can freely flow between the inward sealing surface edge 41 of the annular seal 40 and the supporting surface 21*a* at the upper inward facing collar surface edge of the collar 20. The raised protrusions 38 and gaps 39 are constructed to optimize the amount of minimum suction force required by the user to lift the outer edge of the annular seal 40 resting against the supporting surface 21*a* away from the collar 20 so that the seal can be broken without undue difficulty when a suction force is applied by the user.

When a suction force is applied with a predetermined negative suction pressure to the rim 26 of the collar 20, the inward sealing surface edge 41 of the annular seal 40 will be lifted under the suction force. The inward sealing surface edge 41 will lift off of the supporting surface 21*a* at the collar surface edge with enough height to break the seal and allow the liquid to flow between the raised protrusions 38 and in the gaps 39 on the supporting surface 21*a*.

The annular seal 40 as shown in FIGS. 22 and 29-34 is composed of a flexible valve constructed in a form of a frustoconical disc. As shown in cross section in FIG. 22, the shape of the annular seal 40 is substantially similar to a shape of internal frustoconical shape wall 32, 33, 21*a* of the collar 20. A lower surface 49 of the annular seal 40 has a recess 43 with a blind bore construction on its lower surface 49 and at its center. The blind bore recess 43 is constructed to receive and secure a concentric flange 44 disposed at the lower surface 49 of the annular seal 40 onto the outer extending edge 30 of the projection 27 in the collar 20. As with the other embodiments described, threads 16, 24 are provided at the bottom end of the collar 20 to securely fasten the collar 20 in the container 10.

Figure 34:
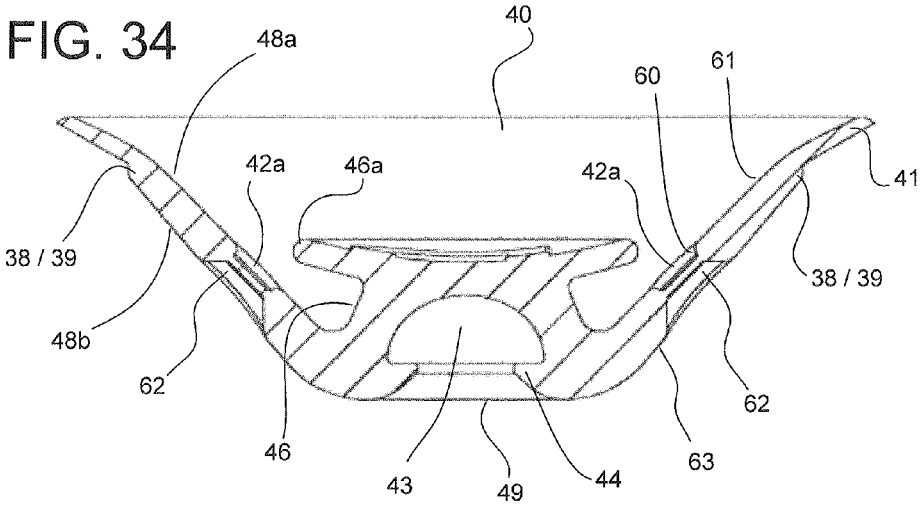
FIG. 34 shows a cross section view of the annular seal of the non-spill container.

In assembly, the annular seal 40 is positioned over an upper surface of the collar 20, opposite a lower surface facing the container 10. The frustoconical shape of the annular seal 40 is also constructed similar in shape and function to a suction cup. The fluid seal of the annular seal 40 occurs between the outermost radial edge 41 of the annular seal 40 and a concentric supporting surface 21*a* provided at the inward facing collar surface edge of the collar 20 adjacent to the rim 26. The frustoconical shape of the annular seal 40 substantially mirrors the inner frustoconical shape of the collar 20. In position, the outermost radial edge 41 of the annular seal 40 and the collar 20 butt up against each other to form a seal. As shown in FIG. 34, the concentric outermost radial edge 41 of the annular seal 40 may be made thinner than the other portions of the annular seal 40 in order to provide a wall with enough of an optimal thickness that will seal the outermost radial edge 41 to the collar 20, albeit a thin enough outermost radial edge 41 that can be easily lifted off to break the seal with a predetermined amount of suction force provided by a user to allow the fluid within the container 10 to flow out of the container assembly 100.

As shown in FIG. 22, the concentric flange 44 extends inwardly at the lower surface 49 entry end of the recess 43 in the annular seal 40. The concentric flange 44 is constructed to provide an engagement and locking mechanism onto which a concentric shoulder 30 of the bulbous head 29 of the projection 27 may be secured. That is, the recess 43 at the lower surface 49 of the annular seal 40 is aligned with and pushed down over the bulbous head 29 until the concentric flange 44 slides over the bulbous head 29 and locks onto the concentric shoulders 30 defining the lower end of the bulbous head 29.

To remove annular seal 40 from the collar 30, the user may grab onto the radially extending flange 46*a* and pull it upward away from the collar 20. In this manner, the concentric flange 44 is lifted off of the shoulder 30 on the projection 27 thereby disengaging the annular seal 40 from collar 30. Removing the annular seal 40 from the collar is an advantage when a user desires to wash and/or clean the various component parts of the container assembly 100. The embodiment provided in FIGS. 20-34 function similar to the various other embodiments provided in this subject disclosure.

Likewise, an advantage of providing the radially extending flange 46*a* is to enable the user to pull the annular seal 40 away from the collar 20 without jeopardize the sealing capabilities of the annular seal 40 itself as a consequence of repetitive removal and installation of the annular valve 40. For example, pushing against the annular seal 40 adjacent to the one-way air vent aperture 42 or pulling against the inward sealing surface edge 41 of the annular seal 40 can potentially permanently deform and/or tear the annular seal 40 at various locations. Some of those sensitive locations being the concentric flange 44, the inward sealing surface edge 41 and/or the one-way air vent aperture 42*a* which could rupture its sealing capabilities.

Figure 33:
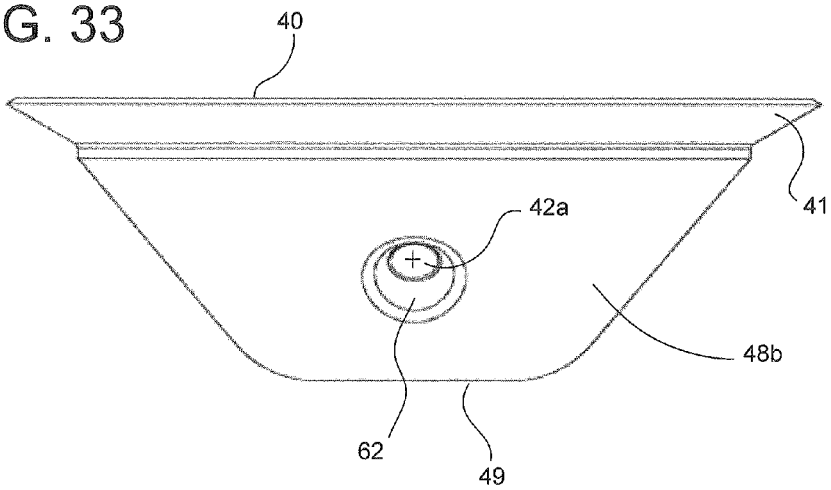
FIG. 33 depicts a side view of the annular seal of the non-spill container.

As shown in more detail in FIGS. 22 and 33-34, the annular seal 40 includes one-way air valve apertures 42*a* aligned with, and in fluid communication with the various radially disposed apertures 34. The one-way air vent valve apertures 42*a* may include a recess 60 on an inner upper surface 61 of the annular seal 40. The valve apertures 42*a* may also include a complimentary recess 62 on a lower surface 63 of the annular seal 40. The complementary recess 62 is adapted to allow the entry of air in from the external atmosphere as the volume of fluid in the container 10 is drawn out to replace the absence of the volume displaced and the vacuum created by the displacement of fluid. The depth of the two recesses 60, 62 are constructed to provide an optimum thickness through which the one-way valve aperture 42*a* in the container assembly 100 is disposed.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A non-spill collar and valve assembly, comprising:

a collar comprising:

a fastener assembly disposed adjacent to a bottom end of the collar provided to securely fasten to a container; and an internal frustoconical wall with an open circular upper end that extends downward and inwardly into a closed lower end, the closed lower end having a projection extending outward from a center of the collar, the internal frustoconical wall further comprising:

a support surface arranged along an inner surface of the open circular upper end;

a plurality of passages disposed in the internal frustoconical wall to channel a fluid; and a plurality of protrusions disposed radially adjacent to the support surface defining various channels; and an annular seal having a first frustoconical surface substantially similar to a shape of the internal frustoconical wall, the annular seal having a blind bore recess on a lower surface at the center for receiving and securing onto the projection.

2. The non-spill collar and valve assembly recited in claim 1, wherein the bottom end of the collar is adapted to receive a gasket between the collar and the container.

3. The non-spill collar and valve assembly recited in claim 1, wherein the annular seal includes a one or more air valves adapted to allow the transfer of air into the container.

4. The non-spill collar and valve assembly recited in claim 1, wherein the annular seal is biased to seal a peripheral edge against the support surface such that the channels are covered by the annular seal.

5. The non-spill collar and valve assembly recited in claim 4, wherein when the peripheral edge of the annular seal is lifted off of the support surface in response to a suction force generated by a mouth of a user, at least one of the channels is partially exposed to form a fluid communication pathway between an interior of the peripheral edge and the support surface of the collar thereby allowing a fluid to flow through the channels into the mouth of the user.

6. The non-spill collar and valve assembly recited in claim 1, wherein the internal frustoconical wall further comprising:

the closed lower wall expanding radially outward from a base of the projection to a first concentric edge;

an intermediate wall extending radially outward and away from the first concentric edge of the closed lower wall at a predetermined angle towards a second concentric edge at an upper end of the intermediate wall; and a second radial ledge expanding radially outward from the upper end of the intermediate wall to the open circular upper end of the collar.

7. The non-spill collar and valve assembly recited in claim 6, wherein the plurality of passages are disposed in the closed lower wall of the internal frustoconical shape wall.

8. The non-spill collar and valve assembly recited in claim 6, wherein the plurality of passages are disposed in the intermediate wall of the internal frustoconical shape wall.

9. The non-spill collar and valve assembly recited in claim 6, wherein the plurality of passages are disposed in the second radial ledge of the internal frustoconical shape wall.

10. The non-spill collar and valve assembly recited in claim 1, wherein an upper edge of the projection extends radially outward beyond a lower portion of an outer surface of a shaft of the projection to define a concentric shoulder.

11. The non-spill collar and valve assembly recited in claim 10, wherein the annular seal comprises a concentric flange extending inwardly from a concentric edge of the blind bore recess, the concentric flange receiving and securing the concentric shoulder of the projection.

12. The non-spill collar and valve assembly recited in claim 1, wherein the annular seal further comprises a raised portion on an upper surface and at the center having a radially outward extending flange to facilitate removing the annular seal from the collar.

13. The non-spill collar and valve assembly recited in claim 1, wherein the plurality of protrusions project outward and adjacent to the support surface of the collar.

14. The non-spill collar and valve assembly recited in claim 1, wherein the plurality of protrusions project away from a lower surface of the peripheral edge of the annular seal toward, and adjacent to, the support surface of the collar.

15. A non-spill collar and valve assembly, comprising:

a collar comprising:

a fastener assembly disposed adjacent to a bottom of the collar provided to securely fasten to a container; and an internal frustum shaped wall with an upper open end that extends downward and inward into a closed lower end, the internal frustum shaped wall further comprising:

a projection extending outward and away from the closed lower end;

a support surface arranged along an inner surface adjacent to the upper open end; and at least one aperture disposed in the internal frustum shaped wall to channel a fluid; and an annual seal having a first surface constructed in a form of a frustum substantially similar to a shape of the internal frustum shaped wall of the collar, the annular seal having an interconnecting portion on a lower surface to be received and secured onto the projection.

16. The non-spill collar and valve assembly recited in claim 15, further comprising a plurality of protrusions disposed radially adjacent to the support surface defining various channels that are closed by a sealing connection between a peripheral edge of the annual seal and the support surface.

17. The non-spill collar and valve assembly recited in claim 16, wherein when the peripheral edge of the annual seal is lifted off of the support surface in response to a suction force generated by a mouth of a user, at least one of the channels is partially exposed to form a fluid communication pathway from: an interior of the container; across the at least one aperture in the internal frustum shaped wall; through a cavity defined between the collar and the annular seal; and through the channel to allow a fluid to flow into the mouth of the user.

18. The non-spill collar and valve assembly recited in claim 15, wherein the internal frustum shaped wall comprises:

the closed lower end from which the projection extends upward;

an intermediate wall extending from a periphery of the closed lower end outward and away at a predetermined angle towards an upper end of the intermediate wall; and a second radial ledge extending outward from the upper end of the intermediate wall to the upper open end of the collar.

19. The non-spill collar and valve assembly recited in claim 15, wherein an upper edge of the projection extends radially outward to define a concentric shoulder, and wherein the interconnecting portion of the annular seal comprises a recess having a concentric flange extending inwardly from an outermost concentric edge of recess, the concentric flange receiving and securing the concentric shoulder of the projection.

20. A non-spill container assembly, comprising:

a container;

a collar comprising:

a fastener assembly disposed adjacent to a bottom of the collar provided to securely fasten to the container; and an internal frustoconical shape wall with an open first end that extends downward and inward into a closed second end, the internal frustoconical shape wall further comprising:

a projection extending outward and away from the closed second end;

a support surface arranged along an inner surface adjacent to the open first end; and at least one aperture disposed in the internal frustoconical shape wall to channel a fluid; and an annual seal having a first surface constructed in a form of a frustoconical disc substantially similar to a shape of the internal frustoconical shape wall of the collar, the annular seal having a blind bore recess on a lower surface at its center to be received and secured onto the projection.

* * * * *